US006984781B2

(12) United States Patent
Mazzoni

(10) Patent No.: US 6,984,781 B2
(45) Date of Patent: Jan. 10, 2006

(54) MUSIC FORMULATION

(76) Inventor: Stephen M. Mazzoni, 22 Brandon Ave., Ewing, NJ (US) 08618

( * ) Notice: Subject to any disclaimer, the term of this patent is extended or adjusted under 35 U.S.C. 154(b) by 346 days.

(21) Appl. No.: 10/384,819

(22) Filed: Mar. 10, 2003

(65) Prior Publication Data

US 2004/0003707 A1 Jan. 8, 2004

Related U.S. Application Data

(63) Continuation-in-part of application No. 10/099,491, filed on Mar. 13, 2002, now abandoned.

(51) Int. Cl.
*G10H 7/00* (2006.01)
*G10H 1/38* (2006.01)

(52) U.S. Cl. ..... 84/613; 84/609; 84/610; 84/615; 84/649; 84/650; 84/653

(58) Field of Classification Search ..... 84/600–603, 84/609–613, 615–616, 634–637, 649–654, 84/666–669
See application file for complete search history.

(56) References Cited

U.S. PATENT DOCUMENTS

| | | | | | |
|---|---|---|---|---|---|
| 5,451,709 | A * | 9/1995 | Minamitaka | ..... | 84/609 |
| 5,753,843 | A | 5/1998 | Fay | | |
| 5,783,767 | A * | 7/1998 | Shinsky | ..... | 84/657 |
| 6,051,770 | A * | 4/2000 | Milburn et al. | ..... | 84/611 |
| 6,060,655 | A | 5/2000 | Minamitaka | | |
| 6,143,971 | A * | 11/2000 | Aoki et al. | ..... | 84/609 |
| 2001/0025561 | A1 * | 10/2001 | Milburn et al. | ..... | 84/609 |
| 2004/0112203 | A1 * | 6/2004 | Ueki et al. | ..... | 84/613 |

* cited by examiner

*Primary Examiner*—Marlon T. Fletcher
(74) *Attorney, Agent, or Firm*—Thomas C. Naber

(57) ABSTRACT

A method for formulating music, methods for formulating individual musical elements for utilization in formulating music, and methods for expanding and/or modifying the musical elements for utilization in formulating music. The musical elements are mathematically derived from origination elements as non-limitedly exemplified by intervals, chords, chord progressions, arpeggios, and instruments, thereby providing a vast array of new elements as attained from mathematical manipulations of such origination elements.

32 Claims, 24 Drawing Sheets

FIGURE 2

MIDI Note Number to Frequency Conversion Chart

| | MIDI Note | Frequency | MIDI Note | Frequency | MIDI Note | Frequency |
|---|---|---|---|---|---|---|
| C | 0 | 8.1757989156 | 12 | 16.3515978313 | 24 | 32.7031956626 |
| Db | 1 | 8.6619572180 | 13 | 17.3239144361 | 25 | 34.6478288721 |
| D | 2 | 9.1770239974 | 14 | 18.3540479948 | 26 | 36.7080959897 |
| Eb | 3 | 9.7227182413 | 15 | 19.4454364826 | 27 | 38.8908729653 |
| E | 4 | 10.3008611535 | 16 | 20.6017223071 | 28 | 41.2034446141 |
| F | 5 | 10.9133822323 | 17 | 21.8267644646 | 29 | 43.6535289291 |
| Gb | 6 | 11.5623257097 | 18 | 23.1246514195 | 30 | 46.2493028390 |
| G | 7 | 12.2498573744 | 19 | 24.4997147489 | 31 | 48.9994294977 |
| Ab | 8 | 12.9782717994 | 20 | 25.9565435987 | 32 | 51.9130871975 |
| A | 9 | 13.7500000000 | 21 | 27.5000000000 | 33 | 55.0000000000 |
| Bb | 10 | 14.5676175474 | 22 | 29.1352350949 | 34 | 58.2704701898 |
| B | 11 | 15.4338531643 | 23 | 30.8677063285 | 35 | 61.7354126570 |
| C | 36 | 65.4063913251 | 48 | 130.8127826503 | 60 | 261.6255653006 |
| Db | 37 | 69.2956577442 | 49 | 138.5913154884 | 61 | 277.1826309769 |
| D | 38 | 73.4161919794 | 50 | 146.8323839587 | 62 | 293.6647679174 |
| Eb | 39 | 77.7817459305 | 51 | 155.5634918610 | 63 | 311.1269837221 |
| E | 40 | 82.4068892282 | 52 | 164.8137784564 | 64 | 329.6275569129 |
| F | 41 | 87.3070578583 | 53 | 174.6141157165 | 65 | 349.2282314330 |
| Gb | 42 | 92.4986056779 | 54 | 184.9972113558 | 66 | 369.9944227116 |
| G | 43 | 97.9988589954 | 55 | 195.9977179909 | 67 | 391.9954359817 |
| Ab | 44 | 103.8261743950 | 56 | 207.6523487900 | 68 | 415.3046975799 |
| A | 45 | 110.0000000000 | 57 | 220.0000000000 | 69 | 440.0000000000 |
| Bb | 46 | 116.5409403795 | 58 | 233.0818807590 | 70 | 466.1637615181 |
| B | 47 | 123.4708253140 | 59 | 246.9416506281 | 71 | 493.8833012561 |
| C | 72 | 523.2511306012 | 84 | 1046.5022612024 | 96 | 2093.0045224048 |
| Db | 73 | 554.3652619537 | 85 | 1108.7305239075 | 97 | 2217.4610478150 |
| D | 74 | 587.3295358348 | 86 | 1174.6590716696 | 98 | 2349.3181433393 |
| Eb | 75 | 622.2539674442 | 87 | 1244.5079348883 | 99 | 2489.0158697766 |
| E | 76 | 659.2551138257 | 88 | 1318.5102276515 | 100 | 2637.0204553030 |
| F | 77 | 698.4564628660 | 89 | 1396.9129257320 | 101 | 2793.8258514640 |
| Gb | 78 | 739.9888454233 | 90 | 1479.9776908465 | 102 | 2959.9553816931 |
| G | 79 | 783.9908719635 | 91 | 1567.9817439270 | 103 | 3135.9634878540 |
| Ab | 80 | 830.6093951599 | 92 | 1661.2187903198 | 104 | 3322.4375806396 |
| A | 81 | 880.0000000000 | 93 | 1760.0000000000 | 105 | 3520.0000000000 |
| Bb | 82 | 932.3275230362 | 94 | 1864.6550460724 | 106 | 3729.3100921447 |
| B | 83 | 987.7666025122 | 95 | 1975.5332050245 | 107 | 3951.0664100490 |
| C | 108 | 4186.0090448096 | 120 | 8372.0180896192 | | |
| Db | 109 | 4434.9220956300 | 121 | 8869.8441912599 | | |
| D | 110 | 4698.6362866785 | 122 | 9397.2725733570 | | |
| Eb | 111 | 4978.0317395533 | 123 | 9956.0634791066 | | |
| E | 112 | 5274.0409106059 | 124 | 10548.0818212118 | | |
| F | 113 | 5587.6517029281 | 125 | 11175.3034058561 | | |
| Gb | 114 | 5919.9107633862 | 126 | 11839.8215267723 | | |
| G | 115 | 6271.9269757080 | 127 | 12543.8539514160 | | |
| Ab | 116 | 6644.8751612791 | | | | |
| A | 117 | 7040.0000000000 | | | | |
| Bb | 118 | 7458.6201842894 | | | | |
| B | 119 | 7902.1328200980 | | | | |

Overall Component Layout

Overall Methodology

Component A Logic
Definition and Configuration of a Musical Instrument

Component B Logic
Definition and Use of Origination Chord to Derive Secondary Chord and Scale Objects Component C Logic
Definition and Use of Origination Scale to Derive Secondary Chord and Scale Objects Component D Logic
Using Origination and/or Derived Chords to Create a Chord Chart Component E Logic The Storage of Chord and Scale Data Component F Logic
The Staff View Component Component G Logic:
The Keyboard View Component Component H Logic:
The Fingerboard View Component Component I Logic:
The Tablature View Component Component J Logic:
The Storage Buffer Component Component B:
Deriving Chord Scales and Context Scales Component B:
Deriving Similar/Related Chords Component B:
Deriving Substitute Chords Component B:
Deriving Context Chords Component B:
Deriving Scale Chords Component C:
Deriving Scale Chords Component C:
Deriving Context Chords Component C:
Deriving Substitute Scales Component C:
Deriving Similar/Related Scales Component C:
Deriving Chord Scales

MUSIC FORMULATION

CROSS-REFERENCE TO RELATED APPLICATIONS

This application is a continuation-in-part of U.S. patent application Ser. No. 10/099,491, filed Mar. 13, 2002, now abandoned.

STATEMENT RE: FEDERALLY SPONSORED RESEARCH/DEVELOPMENT (Not Applicable)

BACKGROUND OF THE INVENTION

The present invention relates in general to the creation, modification, and expansion of music, and in particular to methodology employing the determination and application of mathematical relationships to musical elements such as chords, chord progressions, arpeggios, scales, instruments, and the like such that creation, identification, modification, and expansion of these elements can be accomplished for creative utilization in the music.

Both professional and amateur musicians usually are interested in expanding and/or improving their respective capabilities in the performance of music to thereby produce a unique sound, a unique presentation, and/or a unique instrumentation. Such expansion and improvement can be found in enhanced utilization of special chords, chord progressions, arpeggios, scales, instruments, and the like such that a single composition can be composed in a multitude of styles that create and maintain listener interest. Up to the present time, however, the accomplishment of this greater versatility in music has generally been limited either to a trial-and-error approach employing a musical instrument itself or to utilization of a significantly restricted music-analysis device. With exemplary regard to the latter restricted device, each of these devices provides little else beyond (1) fingering information for a predetermined and non-modifiable number of relatively simple chords or scales (but not both); (2) a predetermined and non-modifiable number of replicable instruments; and (3) single-mode viewability of a chord or scale notational-replication. In other words, these prior art devices do not provide unfettered creativity in the production of music in accord with the outcome sought by creative musicians.

In view of the restrictive nature of the prior art, both as to apparatus and resulting methodology, it is apparent that significant benefits would be gained from a formative approach that is effective in providing enhanced and significant aid in the understanding, modification, and application of various musical elements within a musical composition.

Consequently, a primary object of the present invention is to provide methodology wherein a musician is able to draw from non-preset resources for creating/formulating, identifying, modifying, and expanding musical composition elements.

Another object of the present invention is to provide non-preset resources non-limitedly including musical chord progressions, chord, arpeggio, scale, and instrument identifications and replications, keyboard/fretboard fingering, and staff and tablature notations.

Another object of the present invention is to provide integration of the products of the non-preset resources for selective choice therefrom for composing music.

Another object of the present invention is to provide means for projecting the products of the non-preset resources as a viewable image of at least one of a musical staff image, keyboard image, fretboard/finger board image, and a tablature image.

Still another object of the present invention is to provide means for saving/storing to products of the non-preset resources for future recall.

These and other objects of the present invention will become apparent throughout the description thereof which now follows.

BRIEF SUMMARY OF THE INVENTION

The present invention is a method for composing music as well as for formulating individual elements for utilization in musical compositions.

Throughout this document the following musical terms appear, and are defined according to standard dictionary definitions as well as those definitions recited here below. The term "note" is meant to include all possible audible or inaudible musical pitches/tones and all possible symbols and notations for such pitches/tones. The term "interval" is meant to include the simultaneous (or intended simultaneous) sounding of two played or notated notes, the successive (or intended successive) sounding of two played or notated notes, and a musical metric for the distance between any two played or notated notes. The term "chord" is meant to include the simultaneous (or intended simultaneous) sounding of two or more played or notated notes and all possible played or notated intervals. The term "chord progression" is meant to include any group of one or more played or notated chords. The term "arpeggio" is meant to include the successive (or intended successive) sounding of two or more played or notated notes that are associated with a chord. The terms "chord" and "arpeggio" are meant to be functionally interchangeable as follows: in any place in this document where a chord is an input object of the present invention (e.g. an origination chord), an intermediate object of the present invention, or an output object of the present invention, the aforesaid chord can be accurately interpreted as an arpeggio; and in any place in this document where an arpeggio is an input object of the present invention (e.g., an origination arpeggio), an intermediate object of the present invention, or an output object of the present invention, the aforesaid chord can be accurately interpreted as a chord. The term "scale" is meant to include any ordered set of played or notated notes. The term "instrument" is meant to include all tangible musical devices (with and without strings) non-limitedly including all known fretted and unfretted stringed musical devices (e.g., guitars, bass guitars, mandolins, ukuleles, lutes, violins, fiddles, cellos, double basses, and the like); all known keyboard musical devices (e.g., pianos, electric pianos, synthesizers, harpsichords, and the like); and all known wind-based musical devices (e.g., trumpets, saxophones, flutes, clarinets, tubas, and the like), as well as imaginary, conceptual, or otherwise intangible musical devices. The term "element" is meant to include notes, intervals, chords, chord progressions, arpeggios, scales, and instruments. The term "composition" is meant to include any group of elements such as notes, intervals, chords, chord progressions, arpeggios, and/or scales non-limitedly including tangible objects such as musical scores or notations of such elements that are written or otherwise stored/saved (e.g., in memory on a computer or other device); intangible objects such as performances; and improvisations of the elements that may occur with or without an audience. The term "composing" is meant to include the act of writing or otherwise storing/saving compositions; and the act of creating, formulating, playing, performing, improvising, or otherwise delivering compositions with or without an audience.

Methodology of the present invention comprises a plurality of steps as defined below. Specifically, a first group of steps includes the steps of providing for subsequent choice a plurality of pre-set musical-instrument objects for composing music, providing a mathematical framework for non-limitedly formulating new musical-instrument objects for composing music, choosing one of the aforesaid pre-set musical-instrument objects or applying the aforesaid mathematical framework to non-limitedly formulate for subsequent choice a new musical-instrument object equal to one of the many musical-instrument objects formulatable using the aforesaid mathematical framework, and choosing the new musical-instrument object.

A second group of steps includes the steps of providing for subsequent choice a plurality of chord-progression mathematical relationships for generating chord progressions and determining identity and order of the notes of each chord in a generated chord progression, choosing one of the aforesaid chord-progression mathematical relationships, and applying the chosen chord-progression mathematical relationship to generate a new chord progression equal to all chord progressions formulatable using the chosen chord-progression mathematical relationship.

A third group of steps includes the steps of providing one or more multiple-note origination chords, determining a mathematical relationship among the notes of each origination chord for determining identity and order of the notes of each origination chord, determining a scale-context mathematical relationship for determining compatible context scales with each origination chord, and applying each scale-context mathematical relationship to each origination chord to develop for subsequent choice a plurality of compatible context scales equal to all compatible context scales formulatable using the aforesaid origination chords and the aforesaid scale-context mathematical relationships.

A fourth group of steps includes the steps of providing one or more multiple-note origination scales, determining a mathematical relationship among the notes of each origination scale for determining identity and order of the notes of each origination scale, determining a chord-context mathematical relationship for determining compatible context chords with each origination scale, and applying each chord-context mathematical relationship to each origination scale to develop for subsequent choice a plurality of compatible context chords equal to all compatible context chords formulatable using the aforesaid origination scales and the aforesaid chord-context mathematical relationships.

A fifth group of steps includes the steps of choosing at least one of a newly formulated chord progression, compatible context scale, and compatible context chord from these subsequent choices for utilization in creating music and a step of saving any and/or all of the aforesaid objects for future recall.

One or more additional step-groups as listed below can be performed by a composer to formulate additional musical elements in accord with composer choices. In particular, one such group of steps includes the steps of choosing one of the aforesaid compatible context scales, determining a mathematical relationship for determining identity and order of the notes of the chosen context scale, determining a context-chord expansion mathematical relationship among the notes of the chosen context scale for determining context chords compatible with the chosen context scale, and applying the context-chord expansion mathematical relationship to the chosen context scale to develop for subsequent choice a plurality of context chords equal to all context chords formulatable using the chosen context scale and the aforesaid context-chord expansion mathematical relationship.

Another such step-group includes the steps choosing one of the aforesaid compatible context scales, determining a mathematical relationship among the notes of the chosen context scale for determining identity and order of the notes of the chosen context scale, determining a scale-chord build-pattern mathematical relationship for generating scale chords compatible with the chosen context scale, and applying the scale-chord build-pattern mathematical relationship to the chosen context scale to develop for subsequent choice a plurality of scale chords equal to all scale chords formulatable using the chosen context scale and the aforesaid scale-chord build-pattern mathematical relationship.

Another such step-group includes the steps of determining a chord-scale mathematical relationship for determining chord scales for with each origination chord, and applying each chord-scale mathematical relationship to each origination chord to develop for subsequent choice a plurality of chord scales equal to all chord scales formulatable using the aforesaid origination chords and the aforesaid chord-scale mathematical relationships.

Another such step-group includes the steps of determining a substitute-chord mathematical relationship for determining substitute chords for each origination chord, and applying each substitute-chord mathematical relationship to each origination chord to develop for subsequent choice a plurality of substitute chords equal to all substitute chords formulatable using the aforesaid origination chords and the aforesaid substitute-chord mathematical relationships.

Another such step-group includes the steps of determining a similar/related-chord mathematical relationship for determining similar/related chords for each origination chord, and applying each similar/related-chord mathematical relationship to each origination chord to develop for subsequent choice a plurality of similar/related chords equal to all similar/related chords formulatable using the aforesaid origination chords and the aforesaid similar/related-chord mathematical relationships.

Another such step-group includes the steps of providing a dictionary look-up algorithm for accessing general and chord-specific information about any of the aforesaid origination chords and applying the algorithm to each origination chord to generate for subsequent review and consideration a plurality dictionary look-up information elements equal to all look-up information elements accessible using the aforesaid origination chords and the aforesaid dictionary look-up algorithm. Such information elements include the aforesaid compatible context scales, context chords, scale chords, chord scales, substitute chords, and similar/related chords, and also includes information regarding chord nomenclature, chord classification, and additionally includes a multitude of compositional options and suggestions of ways in which the aforesaid origination chords and derived objects thereof can be creatively utilized in composing music.

Another such step-group includes the steps of determining a series of chord-scale mathematical relationships for each of the aforesaid origination chords for determining chord scales compatible with each origination chord, and applying the chord-scale mathematical relationships to identify and make available a plurality of chord scales for each of the aforesaid origination chords equal to all chord scales formulatable using the aforesaid origination chords and the aforesaid chord-scale mathematical relationships.

Another such step-group includes the steps choosing one of the aforesaid compatible context chords, determining a mathematical relationship among the notes of the chosen context chord for determining identity and order of the notes of the chosen context chord, determining a chord-scale expansion mathematical relationship for determining chord scales for the chosen context chord, and applying the chord-scale expansion mathematical relationship to the chosen context chord to develop for subsequent choice a plurality of chord scales equal to all chord scales formulatable using the chosen context chord and the aforesaid chord-scale expansion mathematical relationship.

Another such step-group includes the steps of determining a scale-chord build-pattern mathematical relationship for generating scale chords compatible with each origination scale, and applying each scale-chord build-pattern mathematical relationship to each origination scale to develop for subsequent choice a plurality of scale chords equal to all scale chords formulatable using the aforesaid origination scales and the aforesaid scale-chord build-pattern mathematical relationships.

Another such step-group includes the steps of determining a context-chord mathematical relationship for determining context chords compatible with each origination scale, and applying each context-chord mathematical relationship to each origination scale to develop for subsequent choice a plurality of context chords equal to all context chords formulatable using the aforesaid origination scales and the aforesaid context-chord mathematical relationships.

Another such step-group includes the steps of determining a similar/related-scale mathematical relationship for determining similar/related scales for each origination scale, and applying each similar/related-scale mathematical relationship to each origination scale to develop for subsequent choice a plurality of similar/related scales equal to all similar/related scales formulatable using the aforesaid origination scales and the aforesaid similar/related-scale mathematical relationships.

Another such step-group includes the steps of determining a substitute-scale mathematical relationship for determining substitute scales for each origination scale, and applying each substitute-scale mathematical relationship to each origination scale to develop for subsequent choice a plurality of substitute scales equal to all substitute scales formulatable using the aforesaid origination scales and the aforesaid substitute-scale mathematical relationships.

Another step-group includes the steps of providing a dictionary look-up algorithm for accessing scale-specific information about any of the aforesaid origination scales and applying the algorithm to generate for subsequent review and consideration a plurality dictionary look-up information elements. Such information elements include the aforesaid compatible context chords, chord scales, scale chords, context chords, similar/related scales, and substitute scales, and also includes information regarding scale nomenclature, scale classification, and additionally includes a multitude of compositional options and suggestions of ways in which the aforesaid origination scales and derived objects thereof can be creatively utilized in composing music.

Another step-group includes the steps of determining a series of scale-chord build-pattern mathematical relationships for each of the aforesaid origination scales for determining scale chords for each origination scale, and applying the scale-chord build-pattern mathematical relationships to identify and make available a plurality of scale chords for each of the aforesaid origination scales equal to all scale chords formulatable using the aforesaid origination scales and the aforesaid scale-chord build-pattern mathematical relationships.

Another step-group includes the steps of choosing at least one of the entirety of newly formulated subsequent choices for utilization in composing music and a step of saving any and/or all of the aforesaid objects for future recall.

The present invention also encompasses methodology for modifying and/or expanding individual elements of a potentially forthcoming composition in which such modified and/or expanded elements are or can be incorporated as chosen by the composer. Thus, with respect to a method for modifying and/or expanding a musical chord where the modifying and/or expanding is founded upon one or more origination chords, the method comprises a plurality of steps as defined below.

Specifically, a first group of steps includes the steps of providing for subsequent choice a plurality of pre-set musical-instrument objects for composing music, providing a mathematical framework for non-limitedly formulating new musical-instrument objects for composing music, choosing one of the aforesaid pre-set musical-instrument objects or applying the aforesaid mathematical framework to non-limitedly formulate for subsequent choice a new musical-instrument object equal to one of the many musical-instrument objects formulatable using the aforesaid mathematical framework, and choosing the new musical-instrument object.

A second group of steps includes the steps of providing one or more multiple-note origination chords, determining a mathematical relationship for determining identity and order of the notes of each origination chord, determining a scale-context mathematical relationship among the notes of each origination chord for determining compatible context scales with each origination chord, and applying each scale-context mathematical relationship to each origination chord to develop for subsequent choice a plurality of compatible context scales equal to all compatible context scales formulatable using the aforesaid origination chords and the aforesaid scale-context mathematical relationships.

A final group of steps includes the steps of choosing at least one of the newly modified and/or expanded compatible context scales from these subsequent choices for utilization in composing the musical composition and a step of saving any and/or all of the aforesaid objects for future recall.

One or more additional step-groups as listed below can be performed by a composer to further modify and/or expand musical elements in accord with composer choices. In particular, one such step-group includes the steps of choosing one of the aforesaid compatible context scales, determining a mathematical relationship for determining identity and order of the notes of the chosen context scale, determining a context-chord expansion mathematical relationship among the notes of the chosen context scale for determining context chords compatible with the chosen context scale, and applying the context-chord expansion mathematical relationship to the chosen context scale to develop for subsequent choice a plurality of context chords equal to all context chords formulatable using the chosen context scale and the aforesaid context-chord expansion mathematical relationship.

Another such step-group includes the steps choosing one of the aforesaid compatible context scales, determining a mathematical relationship among the notes of the chosen context scale for determining identity and order of the notes of the chosen context scale, determining a scale-chord build-pattern mathematical relationship for generating scale chords compatible with the chosen context scale, and applying the scale-chord build-pattern mathematical relationship to the chosen context scale to develop for subsequent choice a plurality of scale chords equal to all scale chords formulatable using the chosen context scale and the aforesaid scale-chord build-pattern mathematical relationship.

Another such step-group includes the steps of determining a chord-scale mathematical relationship for determining chord scales for each origination chord, and applying each chord-scale mathematical relationship to each origination chord to develop for subsequent choice a plurality of chord scales equal to all chord scales formulatable using the aforesaid origination chords and the aforesaid chord-scale mathematical relationships.

Another such step-group includes the steps of determining a substitute-chord mathematical relationship for determining substitute chords for each origination chord, and applying each substitute-chord mathematical relationship to each origination chord to develop for subsequent choice a plurality of substitute chords equal to all substitute chords formulatable using the aforesaid origination chords and the aforesaid substitute-chord mathematical relationships.

Another such step-group includes the steps of determining a similar/related-chord mathematical relationship for determining similar/related chords for each origination chord, and applying each similar/related-chord mathematical relationship to each origination chord to develop for subsequent choice a plurality of similar/related chords equal to all similar/related chords formulatable using the aforesaid origination chords and the aforesaid similar/related-chord mathematical relationships.

Another such step-group includes the steps of providing a dictionary look-up algorithm for accessing chord-specific information about any of the aforesaid origination chords and applying the algorithm to generate for subsequent review and consideration a plurality dictionary look-up information elements. Such information elements include the aforesaid compatible context scales, context chords, scale chords, chord scales, substitute chords, and similar/related chords, and also includes information regarding chord nomenclature, chord classification, and additionally includes a multitude of compositional options and suggestions of ways in which the aforesaid origination chords and derived objects thereof can be creatively utilized in composing music.

Another such step-group includes the steps of determining a series of chord-scale mathematical relationships for each of the aforesaid origination chords for determining chord scales compatible with each origination chord, and applying the chord-scale mathematical relationships to identify and make available a plurality of chord scales for each of the aforesaid origination chords equal to all chord scales formulatable using the aforesaid origination chords and the aforesaid chord-scale mathematical relationships.

Another such step-group includes the steps of a determining key-based transposition mathematical relationship for determining a transposed chord for each origination chord, and applying each key-based transposition mathematical relationship to each origination chord to develop for subsequent choice a plurality of transposed chords equal to all transposed chords formulatable using the aforesaid origination chords and the aforesaid key-based transposition mathematical relationships.

Another such step-group includes the steps of a determining interval-based transposition mathematical relationship for determining a transposed chord for each origination chord, and applying each interval-based transposition mathematical relationship to each origination chord to develop for subsequent choice a plurality of transposed chords equal to all transposed chords formulatable using the aforesaid origination chords and the aforesaid interval-based transposition mathematical relationships.

A final such step-group includes the steps of choosing at least one of the newly modified and/or expanded compatible context scales, compatible context chords, scale chords, chord scales, substitute chords, similar/related chords, dictionary look-up information elements, and transposed chords from these subsequent choices for utilization in composing the musical composition and a step of saving any and/or all of the aforesaid objects for future recall.

With respect to a method for modifying and/or expanding a musical scale where the modifying and/or expanding is founded upon one or more origination scales, the method comprises a plurality of steps as defined below. Specifically, a first group of steps includes the steps of providing for subsequent choice a plurality of pre-set musical-instrument objects for composing music, providing a mathematical framework for non-limitedly formulating new musical-instrument objects for composing music, choosing one of the aforesaid pre-set musical-instrument objects or applying the aforesaid mathematical framework to non-limitedly formulate for subsequent choice a new musical-instrument object equal to one of the many musical-instrument objects formulatable using the aforesaid mathematical framework, and choosing the new musical-instrument object.

A second group of steps includes the steps of providing one or more multiple-note origination scales, determining a mathematical relationship among the notes of each origination scale for determining identity and order of the notes of each origination scale, determining a chord-context mathematical relationship for determining compatible context chords with each origination scale, and applying each chord-context mathematical relationship to each origination scale to develop for subsequent choice a plurality of compatible context chords equal to all compatible context chords formulatable using the aforesaid origination scales and the aforesaid chord-context mathematical relationships.

A final group of steps includes the steps of choosing at least one of the newly modified and/or expanded compatible context chords from these subsequent choices for utilization in composing the musical composition and a step of saving any and/or all of the aforesaid objects for future recall.

One or more additional step-groups as listed below can be performed by a composer to further modify and/or expand musical elements in accord with composer choices. In particular, another such step-group includes the steps choosing one of the aforesaid compatible context chords, determining a mathematical relationship among the notes of the chosen context chord for determining identity and order of the notes of the chosen context chord, determining a chord-scale expansion mathematical relationship for determining chord scales for the chosen context chord, and applying the chord-scale expansion mathematical relationship to the chosen context chord to develop for subsequent choice a plurality of chord scales equal to all chord scales formulatable using the chosen context chord and the aforesaid chord-scale expansion mathematical relationship.

Another such step-group includes the steps of determining a scale-chord build-pattern mathematical relationship for generating scale chords compatible with each origination scale, and applying each scale-chord build-pattern mathematical relationship to each origination scale to develop for subsequent choice a plurality of scale chords equal to all scale chords formulatable using the aforesaid origination scales and the aforesaid scale-chord build-pattern mathematical relationships.

Another such step-group includes the steps of determining a context-chord mathematical relationship for determining context chords compatible with each origination scale, and applying each context-chord mathematical relationship to each origination scale to develop for subsequent choice a plurality of context chords equal to all context chords formulatable using the aforesaid origination scales and the aforesaid context-chord mathematical relationships.

Another such step-group includes the steps of determining a similar/related-scale mathematical relationship for determining similar/related scales for each origination scale, and applying each similar/related-scale mathematical relationship to each origination scale to develop for subsequent choice a plurality of similar/related scales equal to all similar/related scales formulatable using the aforesaid origination scales and the aforesaid similar/related-scale mathematical relationships.

Another such step-group includes the steps of determining a substitute-scale mathematical relationship for determining substitute scales for each origination scale, and applying each substitute-scale mathematical relationship to each origination scale to develop for subsequent choice a plurality of substitute scales equal to all substitute scales formulatable using the aforesaid origination scales and the aforesaid substitute-scale mathematical relationships.

Another such step-group includes the steps of providing a dictionary look-up algorithm for accessing scale-specific information about any of the aforesaid origination scales and applying the algorithm to generate for subsequent review and consideration a plurality dictionary look-up information elements. Such information elements include the aforesaid compatible context chords, chord scales, scale chords, context chords, similar/related scales, and substitute scales, and also includes information regarding scale nomenclature, scale classification, and additionally includes a multitude of compositional options and suggestions of ways in which the aforesaid origination scales and derived objects thereof can be creatively utilized in composing music.

Another such step-group includes the steps of determining a series of scale-chord build-pattern mathematical relationships for each of the aforesaid origination scales for determining scale chords for each origination scale, and applying the scale-chord build-pattern mathematical relationships to identify and make available a plurality of scale chords for each of the aforesaid origination scales equal to all scale chords formulatable using the aforesaid origination scales and the aforesaid scale-chord build-pattern mathematical relationships.

A final such step-group includes the steps of choosing at least one of the newly modified and/or expanded compatible context chords, chord scales, scale chords, context chords, similar/related scales, substitute scales, and dictionary look-up information elements from these subsequent choices for utilization in the musical composition and a step of saving any and/or all of the aforesaid objects for future recall.

For all potential compositions and elements thereof identified and/or developed according to methodology as above described, computer implementation is preferably employed, with such implementation employing microprocessor-driven recognition algorithms developed as known in the art for the application of all of the above-identified mathematical relationships and the ultimate derivation of respective results. Additionally, and in accord with such computer association, any or all potential compositions as well as elements thereof can be saved for recall; projected as viewable images on at least one of a virtual keyboard image, musical staff image, fretboard/fingerboard image, and tablature image; or otherwise manipulated in accord with the capabilities of the particular computer being used.

BRIEF DESCRIPTION OF THE DRAWINGS

An illustrative and presently preferred embodiment of the invention is shown in the accompanying drawing in which:

FIG. 2 shows a conversion chart of MIDI note numbers to frequencies in Hertz;

DETAILED DESCRIPTION OF THE INVENTION

Figure 1:
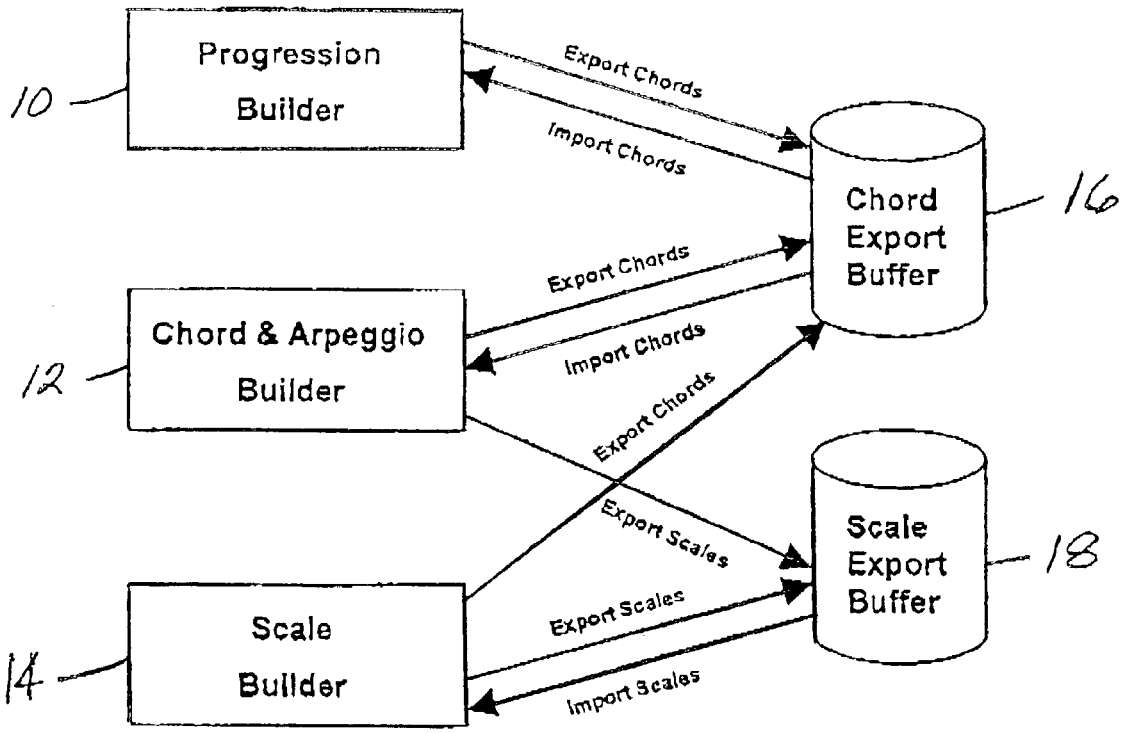
FIG. 1 is a flow diagram of interactions among program modules for composing music in accord with the present invention.

As earlier expressed, computer implementation is preferably employed in the practice of the novel methodology here defined, with such implementation employing microprocessor-driven recognition algorithms developed as known in the art for the application and respective result-derivations of all of the mathematical relationships and the ultimate derivation of respective results. FIG. 1 provides an overview of three modules conventionally incorporated to achieve the goals of the invention. In particular, these modules are a progression builder (PB) module 10, a chord/arpeggio builder (CAB) module 12, and a scale builder (SB) module 14. A chord export buffer 16 and a scale export buffer 18 are provided such that chord data and scale data can be transferred to and from all of the modules 10, 12, 14 allowing for inter-module integration while composing music, formulating elements for that composition, or modifying and/or expanding elements for a potentially forthcoming composition.

A primary purpose of the PB module 10 is to create and display chord progressions in high-level notation (e.g., Road Map/Jazz). This level of notation typically deals with the functional structure of a piece of music in the context of its chords and their functions in relation to various key centers.

Operationally, a user adds one or more multiple-note origination chords to the PB module 10 using one of the following methods. One such method for adding origination chords to the PB module 10 is by choosing various chord attributes associated with underlying mathematical recognition/derivation algorithms and implementing the algorithms to formulate a chord. Another method for adding origination chords to the PB module 10 is choosing a chord-progression mathematical relationship for generating new chord progressions and applying an associated mathematical algorithm to formulate a new chord progression containing one or more chords. Another method for adding origination chords to the PB module 10 is to open a pre-formulated composition containing one or more pre-formulated chords that was previously created using PB module 10. Still another method of adding origination chords to the PB module 10 is to import pre-formulated origination chords that were previously exported to the chord export buffer 16 from the PB module 10, the CAB module 12, or the SB module 14.

Having added one or more origination chords to the PB module 10 using one of the foregoing methods, the user can clone selected chords using copy/paste functionality. Then, the user can modify the original chords and/or the clones using the aforesaid mathematical relationships and associated algorithms. For one or more origination chords, a key-based transposition mathematical relationship among the notes of the origination chords determines transposed chords for the origination chords, and the entire plurality of such transposed chords based upon the origination chords and the mathematical relationships thereof are made available for the origination chords. For one or more origination chords, a interval-based transposition mathematical relationship among the notes of the origination chords determines transposed chords for the origination chords, and the entire plurality of such transposed chords based upon the origination chords and the mathematical relationships thereof are made available for the origination chords. The user can choose at least one of the aforesaid newly formulated, opened, imported, cloned, modified, and/or transposed origination chords for utilization in the musical composition.

The user can choose from a plurality of pre-set musical-instrument objects or implement a mathematical framework for non-limitedly formulating new musical-instrument objects to formulate one or more musical-instrument objects. Having formulated such musical-instrument objects, the user must select a single musical-instrument object for each open composition in PB module 10. These selected musical-instrument objects influence the various chord-viewing options in PB module 10 as defined below. Any of the aforesaid origination chords can be selectively projected by user choice of the monitor of the computer as a viewable image of at least one of a keyboard image, a musical staff image, a fretboard/fingerboard image, and a tablature image. The user can add a large variety of other musical notation symbols to the composition that non-limitedly show relative duration for chords, composition tempo, section and measure demarcation, the composition title and authorship, and the like. The user can export all of the origination chords in the composition to the chord export buffer 16 for subsequent importation into another currently open composition in PB module 10 or the CAB module 12. The user can work on multiple compositions at the same time, transferring the aforesaid origination chords freely between the various compositions using the aforesaid methodology. All of the aforesaid functionality applies to any and all of these compositions. Finally, the user can store any and all of the compositions and musical-instrument objects for future recall.

The CAB module 12 is a tool for formulating and identifying an origination chord, as well as deriving, making available, viewing, and saving/storing a diverse array of musical elements associated with the origination chord. The derived musical elements can be implemented in composing music without modification or can be subsequently modified by exportation to the chord export buffer 16 and importation back into CAB module 12 or importation into PB module 10. The CAB module 12 requires at least one origination chord as an input object. Based on these origination chord(s), the CAB module 12 derives an extensive set of musical elements (chords/arpeggios, and scales). These derived musical elements can be projected on the computer monitor as a viewable image of at least one of a musical staff image, keyboard image, fretboard/fingerboard image, and a tablature image. Additionally, the CAB module 12 allows users to access extensive general and chord-specific information pertaining to the origination chord(s) and the derived musical elements, generating a vast assortment of compositional options and suggestions of ways in which the origination chord(s) and the derived musical elements can be utilized in composing music. The CAB module 12 also provides users with multiple means of saving/storing the origination chord(s) and the derived musical elements for future recall.

Operationally, a user adds one or more multiple-note origination chords to the CAB module 12 using one of the following methods. One such method for adding origination chords to the CAB module 12 is by choosing various chord attributes associated with underlying mathematical recognition/derivation algorithms and implementing the algorithms to formulate a chord. Another method for adding origination chords to the CAB module 12 is to open a set of pre-formulated origination chords that were previously created using the PB module 10, the CAB module 12, or the SB module 14. Still another method of adding origination chords to the CAB module 12 is to import pre-formulated origination chords that were previously exported to the chord export buffer 16 from the PB module 10, the CAB module 12, or the SB module 14. For each origination chord, an algorithmic scale-context mathematical relationship determines context scales compatible with each origination chord, and the entire plurality of such compatible context scales based upon each origination chord and the mathematical relationships thereof are made available for each origination chord.

For each origination chord and a selected context scale, an algorithmic context-chord expansion mathematical relationship determines context chords compatible with the context scale, and the entire plurality of such context chords based upon each origination chord, selected context scale, and the mathematical relationship thereof are made available for each origination chord and selected context scale. For each origination chord and a selected context scale, an algorithmic scale-chord build-pattern mathematical relationship determines scale chords compatible with the context scale, and the entire plurality of such scale chords based upon each origination chord, selected context scale, and the mathematical relationship thereof are made available for each origination chord and selected context scale. For each origination chord, an algorithmic chord-scale mathematical relationship determines chord scales for each origination chord, and the entire plurality of such chord scales based upon each origination chord and the mathematical relationship thereof are made available for each origination chord. For each origination chord, an algorithmic substitute-chord mathematical relationship determines substitute chords compatible each origination chord, and the entire plurality of such substitute chords based upon each origination chord and the mathematical relationship thereof are made available for each origination chord. For each origination chord, an algorithmic similar/related-chord mathematical relationship determines similar/related chords for each origination chord, and the entire plurality of such similar/related chords based upon each origination chord and the mathematical relationship thereof are made available for each origination chord.

The user can now choose at least one of the newly formulated compatible context scales, context chords, scale chords, chord scales, substitute chords, and similar/related chords from these subsequent choices for utilization in the musical composition. The user can choose from a plurality of pre-set musical-instrument objects or implement a mathematical framework for non-limitedly formulating new musical-instrument objects to formulate one or more musical-instrument objects. Having formulated the musical-instrument objects, the user must select a single musical-instrument for CAB module 12. The selected musical-instrument object influences the various chord-viewing options in CAB module 12 as defined below. Any of the aforesaid origination chords can be selectively projected by user choice of the monitor of the computer as a viewable image of at least one of a keyboard image, a musical staff image, a fretboard/fingerboard image, and a tablature image. The user can implement a dictionary look-up algorithm to research or learn more information about any of the aforesaid origination chords. Such chord-specific information includes the aforesaid compatible context scales, context chords, scale chords, chord scales, substitute chords, and similar/related chords, and also includes information regarding chord nomenclature, chord classification, and a multitude of compositional options and suggestions. These compositional options and suggestions offer the user a plethora of ways in which the origination chords and derived objects thereof can be utilized in composing music. The user can implement a chord progression analysis algorithm to identify and make available a plurality of chord scales for each of a plurality of origination chords. This algorithm allows the user to locate the possible key centers of any given chord progression in a single step. The aforesaid chord scales can be exported to the scale export buffer 18 for subsequent importation into SB module 14. The user can export any or all of the aforesaid origination chord(s) or chord(s) derived thereof to the chord export buffer 16 for subsequent importation into PB module 10 or back into CAB module 12. The user can export any or all of the aforesaid derived scales to the scale export buffer 18 for subsequent importation into SB module 14. Finally, the user can store the entire set of origination chords and musical-instrument objects for future recall.

The SB module 14 is a tool for formulating and identifying an origination scale, as well as deriving, making available, viewing, and saving/storing a diverse array of musical elements associated with the origination scale. The derived musical elements can be implemented in composing music without modification or can be subsequently modified by exportation to the scale export buffer 18 and importation back into SB module 14. The SB module 14 requires at least one origination scale as an input object. Based on the origination scale(s), the SB module 14 derives an extensive set of musical elements (chords/arpeggios, and scales). These derived musical elements can be projected on the computer monitor as a viewable image of at least one of a musical staff image, keyboard image, fretboard/fingerboard image, and a tablature image. Additionally, the SB module 14 allows users to access extensive general and scale-specific information pertaining to the origination scale(s) and the derived musical elements, generating a vast assortment of compositional options and suggestions of ways in which the origination scale(s) and the derived musical elements can be utilized in composing music. The SB module 14 also provides users with multiple means of saving/storing the origination scale(s) and the derived musical elements for future recall. Operationally, a user adds one or more multiple-note origination scales to the SB module 14 using one of the following methods. One such method for adding origination scales to the SB module 14 is by choosing various scale attributes associated with underlying mathematical recognition algorithms and implementing the algorithms to formulate a scale. Another method for adding origination scales to the SB module 14 is to open a set of pre-formulated origination scales that were previously created using the SB module 14. Still another method of adding origination scales to the SB module 14 is to import pre-formulated origination scales that were previously exported to the scale export buffer 18 from the CAB module 12 or the SB module 14.

For each origination scale, an algorithmic chord-context mathematical relationship determines context chords compatible with each origination scale, and the entire plurality of such compatible context chords based upon each origination scale and the mathematical relationship thereof are made available for each origination scale. For each origination scale and a selected context chord, an algorithmic chord-scale expansion mathematical relationship determines chord scales for the context chord, and the entire plurality of such chord scales based upon each origination scale, selected context chord, and the mathematical relationship thereof are made available for each origination scale and selected context chord. For each origination scale, an algorithmic scale-chord build-pattern mathematical relationship determines scale chords compatible with each origination scale, and the entire plurality of such scale chords based upon each origination scale and the mathematical relationship thereof are made available for each origination scale. For each origination scale, an algorithmic context-chord mathematical relationship determines context chords compatible with each origination scale, and the entire plurality of such context chords based upon each origination scale and the mathematical relationship thereof are made available for each origination scale. For each origination scale, an algorithmic similar/related-scale mathematical relationship determines similar/related scales compatible with each origination scale, and the entire plurality of such similar/related scales based upon each origination scale and the mathematical relationship thereof are made available for each origination scale. For each origination scale, an algorithmic substitute-scale mathematical relationship determines substitute scales for each origination scale, and the entire plurality of such substitute scales based upon each origination scale and the mathematical relationship thereof are made available for each origination scale.

The user can now choose at least one of the newly formulated compatible context chords, chord scales, scale chords, context chords, similar/related scales, and substitute scales from these subsequent choices for utilization in the musical composition. The user can choose from a plurality of pre-set musical-instrument objects or implement a mathematical framework for non-limitedly formulating new musical-instrument objects to formulate one or more musical-instrument objects. Having formulated the musical-instrument objects, the user must select a single musical-instrument for SB module 14. The selected musical-instrument object influences the various chord-viewing options in SB module 14 as defined below. Any of the aforesaid origination chords can be selectively projected by user choice of the monitor of the computer as a viewable image of at least one of a keyboard image, a musical staff image, a fretboard/fingerboard image, and a tablature image. The user can implement a dictionary look-up algorithm to research or learn more information about any of the aforesaid origination scales. Such scale-specific information includes the formulated compatible context chords, chord scales, scale chords, context chords, similar/related scales, and substitute scales, and also includes information regarding scale nomenclature, scale classification, and a multitude of compositional options and suggestions. These compositional options and suggestions offer the user a plethora of ways in which the origination chords and derived objects thereof can be utilized in composing music. The user can implement a chord progression assembly algorithm to identify and make available a plurality of scale chords for each of a plurality of origination scales. This algorithm allows the user to user to generate the possible scale chords each origination scale based on a set of choices, access and manipulate the scale chords, and pre-formulate a chord progression incorporating the scale chords in any order and including various additional musical notation symbols that indicate chord duration, compositional section, measure, and line demarcation, and degree of repetition. The aforesaid group of generated scale chords and musical notation symbols can be directly inserted in the PB module 10 or exported to the chord export buffer 16 for subsequent importation into PB module 10, CAB module 12, or back into SB module 14. The user can export any or all of the aforesaid origination scale(s) or scales derived thereof to the scale export buffer 18 for subsequent importation back into SB module 14. The user can export any or all of the aforesaid derived intervals, chords, and arpeggios to the chord export buffer 16 for subsequent importation into PB module 10 or CAB module 12. Finally, the user can store the entire set of origination scales and musical-instrument objects for future recall.

While each of the modules 10, 12, and 14 produce independent work products, they very effectively contribute to each other, thereby working in concert, to create music. The PB module 10 permits the display of one or more chords. The CAB module 12 permits the extensive exploration and evaluation of compositional options associated with any chord or arpeggio. The SB module 14 permits the extensive exploration and evaluation of compositional options associated with any scale. The work products of PB module 10 complement the work products of the CAB module 12 and SB module 14, and in the preferred embodiment, provide importation and display of the CAB module 12 and SB module 14 work products (as well as PB module 10 work products) in the course of composing music. The work products of CAB module 12 complement the work products of the PB module 10 and SB module 14, and in the preferred embodiment, provide importation and display of the PB module 10 and SB module 14 work products (as well as CAB module 12 work products) in the course of composing music. The work products of SB module 14 complement the work products of the PB module 10 and CAB module 12, and in the preferred embodiment, provide importation and display of the CAB module 12 work products (as well as SB module 14 work products) in the course of composing music.

In a first non-limiting example, a hypothetical user has sheet music for a popular song. The sheet contains six different chords, and the user's objective is fivefold. First, the user wants to learn how to play all six of these chords on a conventional six-string guitar. Second, the user wants to learn more about these six chords in a more general sense, such that he/she becomes aware of possible improvisational options and ideas that are associated with these six chords. Third, the user wants to generate a list of chord scales for each of the six chords. Fourth, the user wants to learn more about each of the chord scales in a more general sense, such that he/she becomes aware of possible improvisational options and ideas that are associated with these chord scales. Fifth, the user wants to extend, reorder, or otherwise modify the original sheet music chords thereby producing an original presentation reflecting his/her personal authorship and preferences for appealing/tasteful sounds.

Using the aforesaid methodology, the user first formulates a six-string guitar musical-instrument object. The user then engages the PB module 10 by adding these six origination chords using the aforesaid methodology for formulating chords in PB module 10. Next, the user exports all six chords to the chord export buffer 16, engages the CAB module 12, and imports all six chords into CAB module 12. The user is now able project each of the six chords onto the monitor of the computer as a viewable image of a keyboard image, a musical staff image, a fretboard/fingerboard image, and a tablature image. This allows the user to fulfill his/her first objective.

The user engages the aforesaid dictionary look-up algorithm in CAB module 12 to learn more about the six chords in a more general sense and become aware of possible improvisational options and ideas that are associated with each of the six chords. This allows the user to fulfill his/her second objective.

The user engages the aforesaid chord progression analysis algorithm in CAB module 12 to identify and make available a plurality of chord scales for each of the six origination chords. This allows the user to fulfill his/her third objective.

The user exports all such chord scales to the scale export buffer 18, engages the SB module 16, and imports the aforesaid chord scales into SB module 14. After engaging the aforesaid dictionary look-up algorithm in SB module 14, the user is able to learn more about each of the chord scales in a more general sense, such that he/she becomes aware of possible improvisational options and ideas that are associated with these chord scales. This allows the user to fulfill his/her fourth objective.

Finally, the user re-engages the PB module 10. After altering, rearranging, reordering, and customizing the six origination chords and adding various musical notation elements to suit his/her choices, the user has formulated a composition reflecting his/her personal authorship and preferences for appealing/tasteful sounds. This allows the user to fulfill his/her fifth objective.

Finally, and non-essentially, the user stores the six chords and the aforesaid six-string guitar musical-instrument object for future recall.

EXAMPLE 2

In a second non-limiting example, a hypothetical user has a scale in mind that he/she wants to further research/explore. The user's objective is sevenfold. First, the user wants to learn how to play the scale on a nine-string guitar. Second, the user wants to learn more about the scale in a more general sense, such that he/she becomes aware of possible improvisational options and ideas that are associated with the scale. Third, the user wants to generate a list of scale chords that are associated with the scale. Fourth, the user wants to learn how to play each of the aforesaid scale chords on a nine-string guitar. Fifth, the user wants to learn more about each of the scale chords in a more general sense, such that he/she becomes aware of possible improvisational options and ideas that are associated with each of these scale chords. Sixth, the user wants generate a list of other scales that can be used in conjunction with each of the scale chords. Seventh, the user wants to use the scale chords in composing music.

Using the aforesaid methodology, the user formulates a nine-string guitar musical-instrument object. The user engages the SB module 14 and formulates the desired origination scale using the aforesaid methodology. The user is now able project the origination scale onto the monitor of the computer as a viewable image of a keyboard image, a musical staff image, a fretboard/fingerboard image, and a tablature image. This allows the user to fulfill his/her first objective.

The user engages the aforesaid dictionary look-up algorithm in SB module 14 to learn more about the origination scale in a more general sense and become aware of possible improvisational options and ideas that are associated with the origination scale. This allows the user to fulfill his/her second objective.

The user engages the aforesaid chord progression assembly algorithm in SB module 14 to identify and make available a plurality of scale chords associated with the origination scale. This allows the user to fulfill his/her third objective.

The user exports all aforesaid scale chords to the chord export buffer 16, engages the CAB module 12, and imports the aforesaid scale chords into the CAB module 12. The user is now able project each of the scale chords onto the monitor of the computer as a viewable image of a keyboard image, a musical staff image, a fretboard/fingerboard image, and a tablature image. This allows the user to fulfill his/her fourth objective.

After engaging the aforesaid dictionary look-up algorithm in CAB module 12, the user is able to learn more about each of the scale chords in a more general sense, such that he/she becomes aware of possible improvisational options and ideas that are associated with these scale chords. This allows the user to fulfill his/her fifth objective.

The user engages the aforesaid chord progression analysis algorithm in CAB module 12 to identify and make available a plurality of chord scales for each of the scale chords. This allows the user to fulfill his/her sixth objective.

The user engages PB module 10, and imports the aforesaid scale chords from the chord export buffer 16 to the PB module 10. After rearranging, reordering, and customizing the scale chords and adding various musical notation elements to suit his/her choices, the user has formulated a composition. This allows the user to fulfill his/her seventh objective.

Finally, and non-essentially, the user stores the newly formulated composition and nine-string guitar musical-instrument object for future recall.

Figure 3:
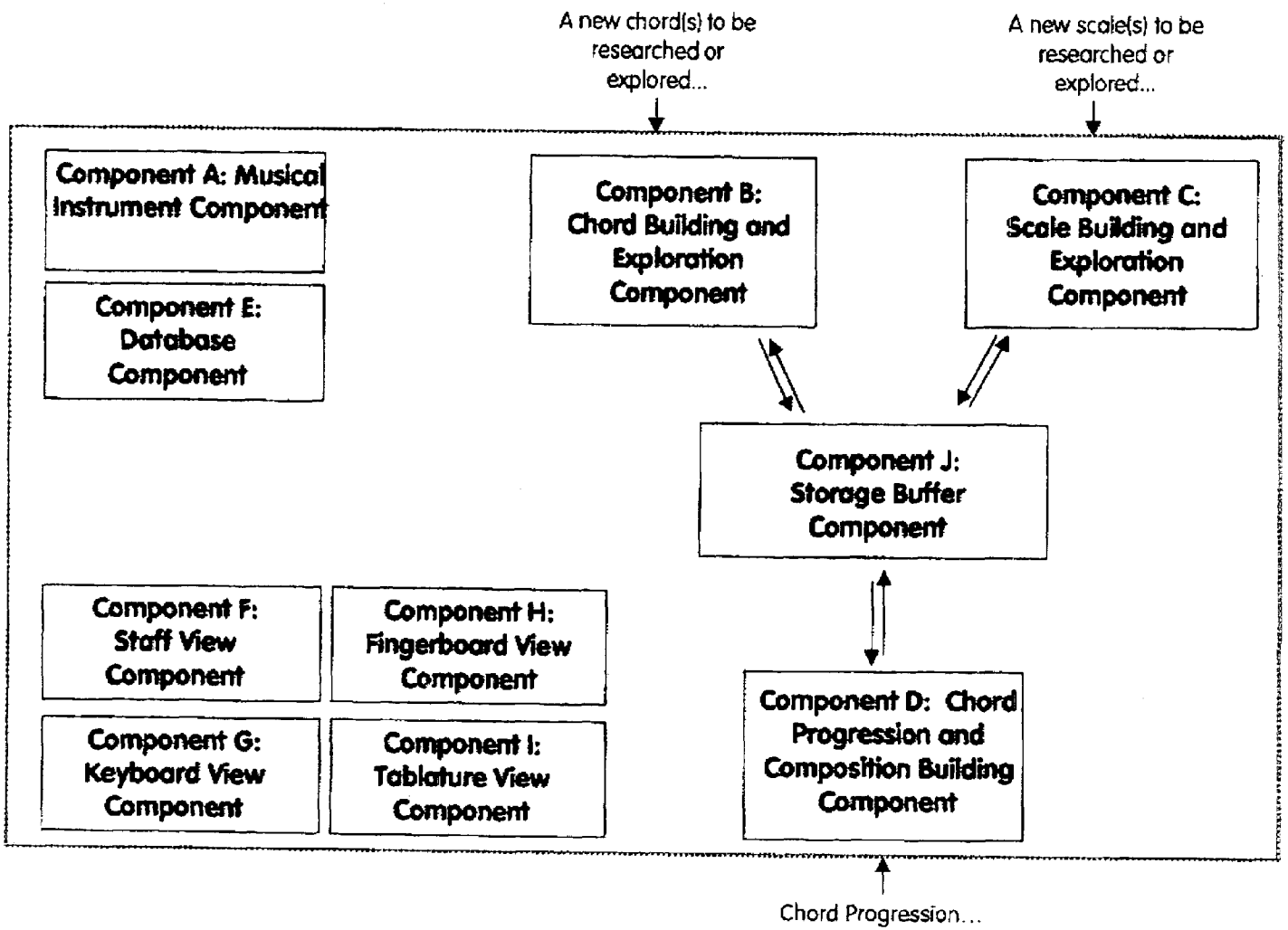
FIG. 3 shows overall design/methodology by element of the present invention.
Figure 4:
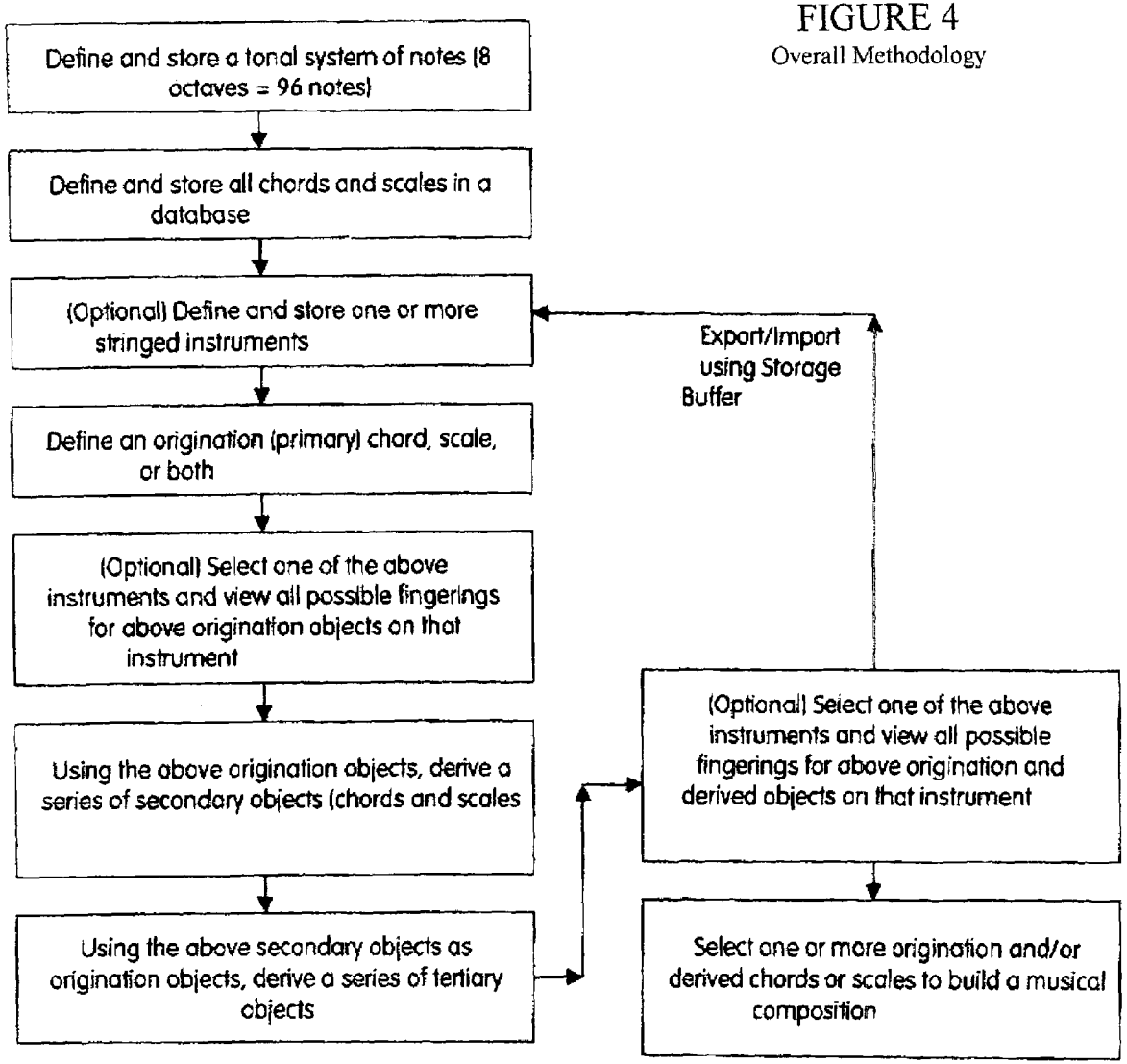
FIG. 4 shows overall methodology of the present invention.
Figure 5:
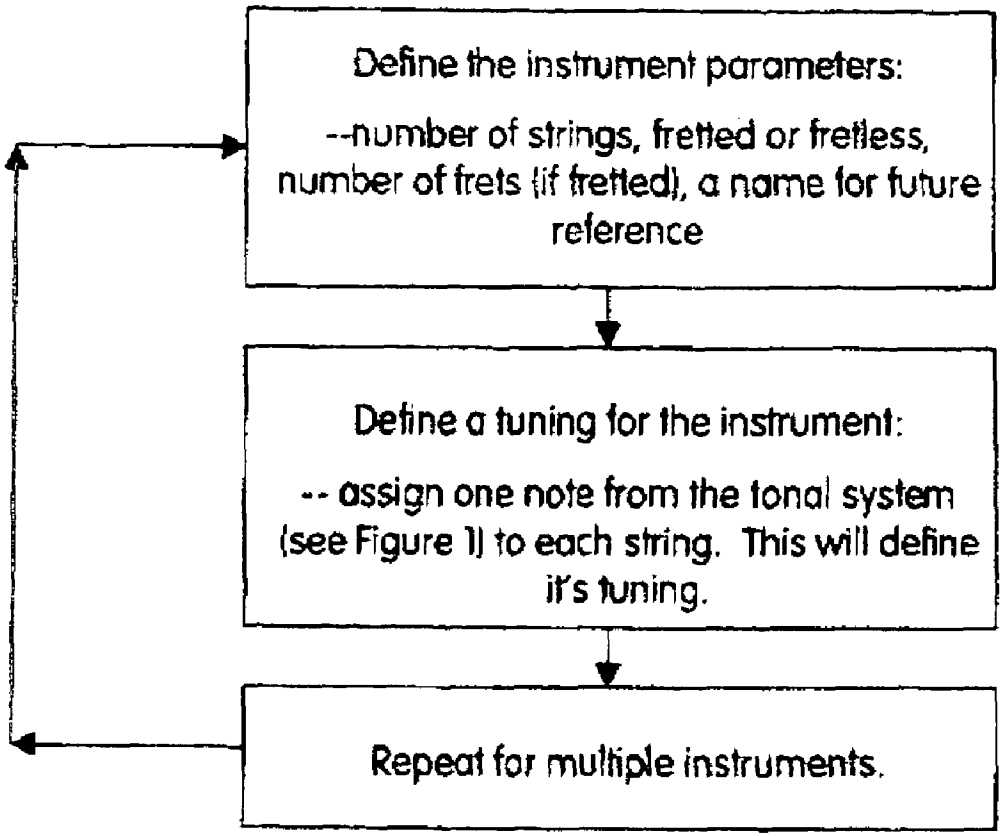
FIG. 5 shows the definition and configuration of one or more stringed musical instruments (Element A logic)
Figure 6:
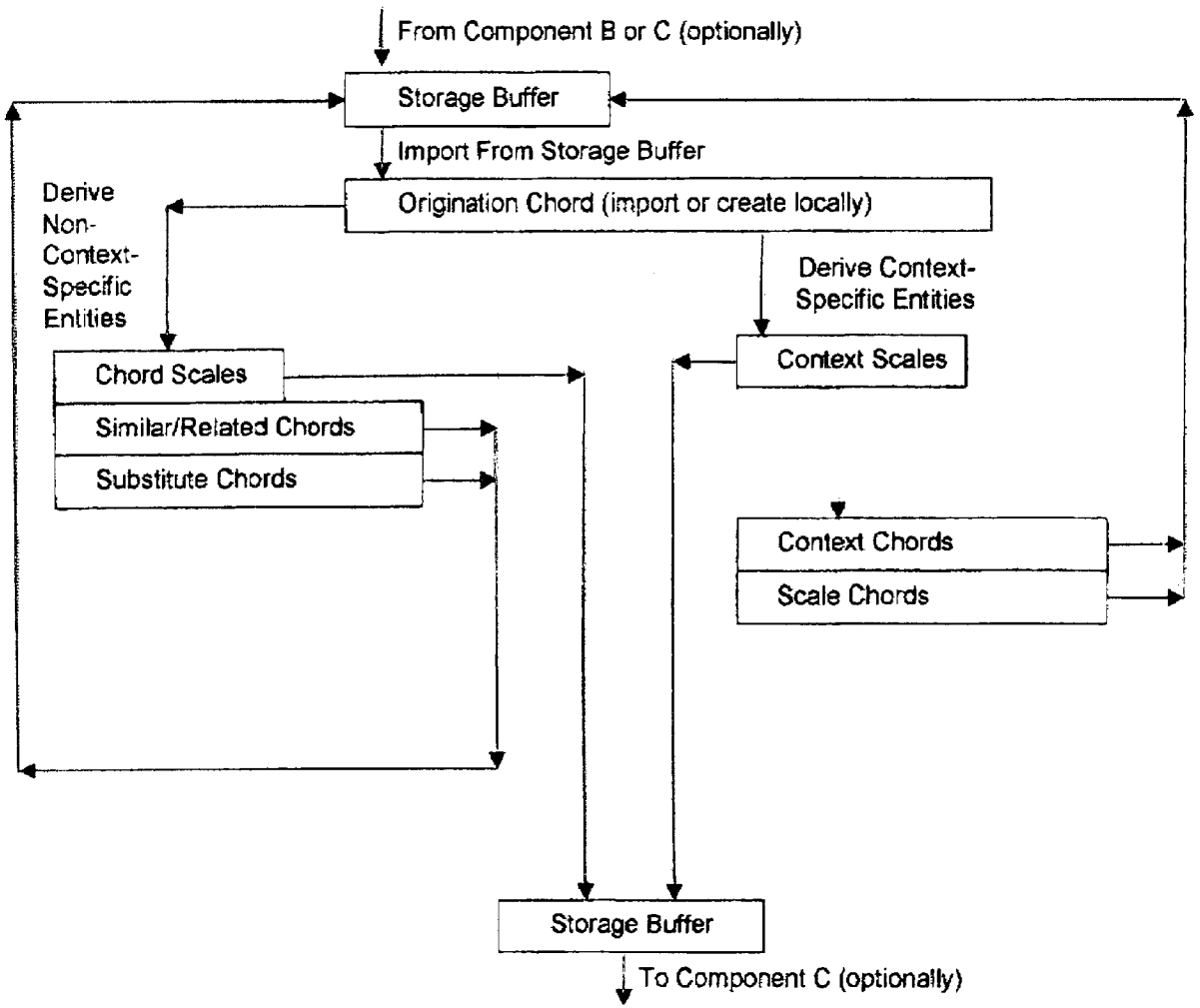
FIG. 6 shows the definition and use of an origination chord for derivation of secondary chord and scale objects (Element B logic)
Figure 7:
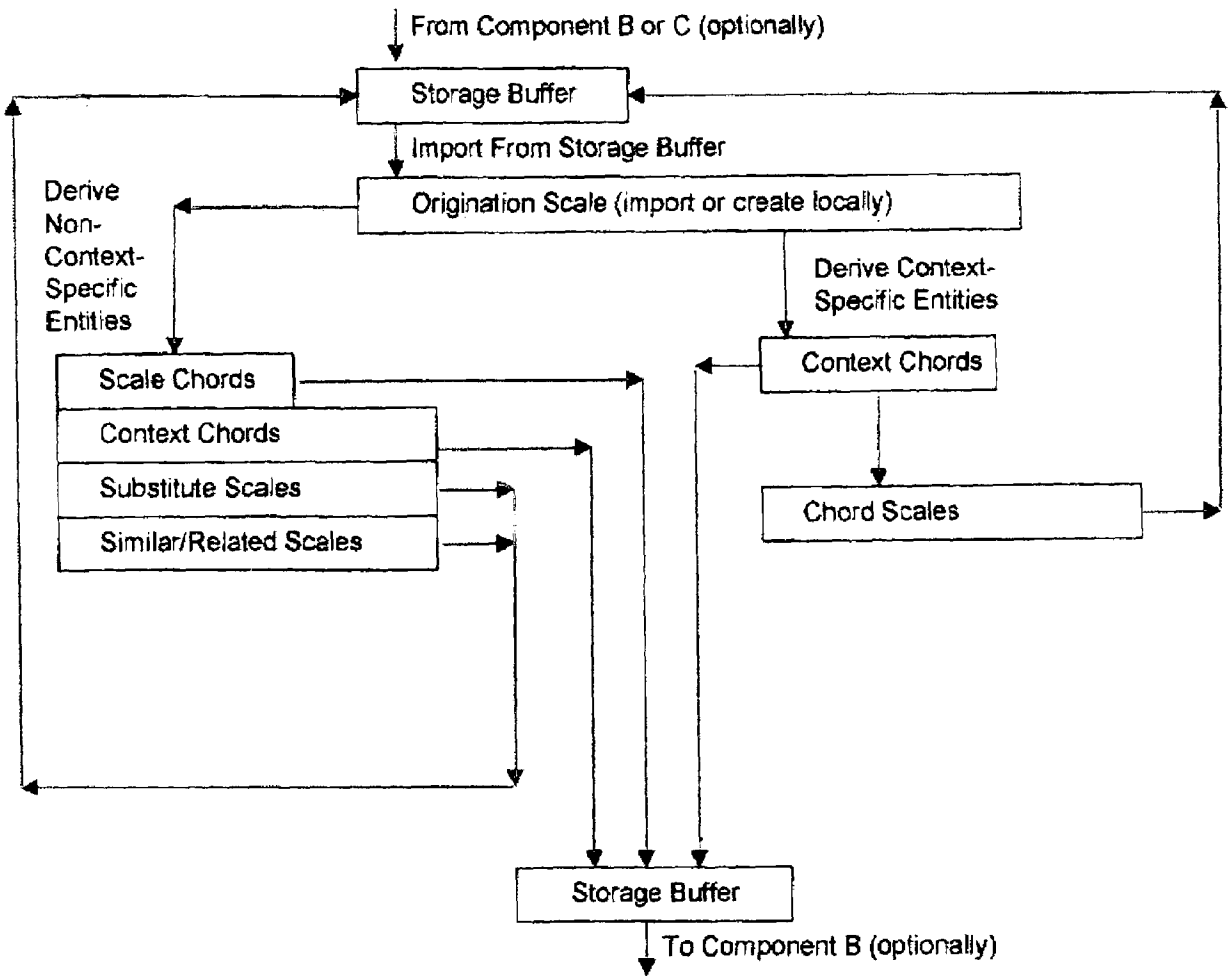
FIG. 7 shows the definition and use of an origination scale for derivation of secondary chord and scale objects (Element C logic)
Figure 8:
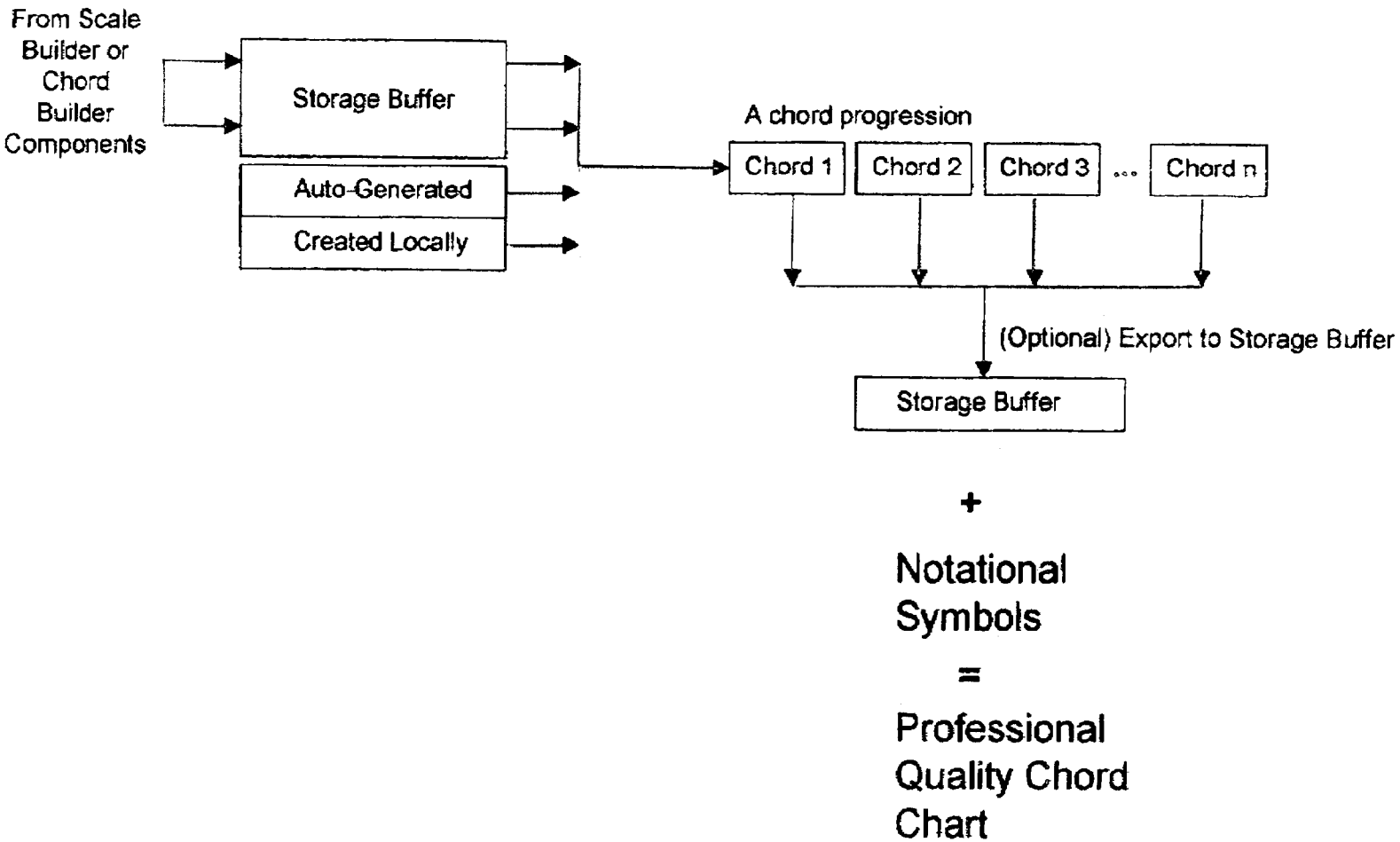
FIG. 8 shows the use of origination and/or derived chords to create a chord chart (Element D logic)
Figure 9:
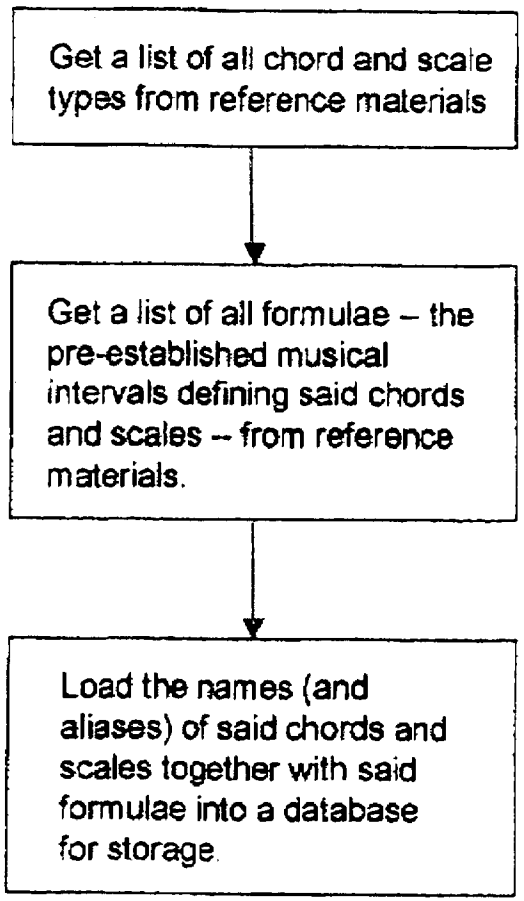
FIG. 9 shows the storage of chord and scale data (Element E logic)
Figure 10:
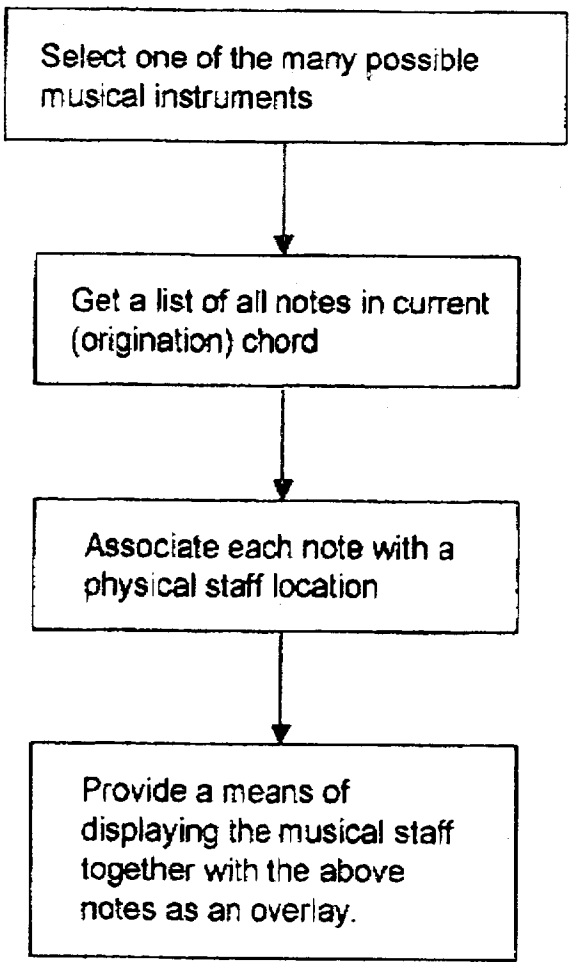
FIG. 10 shows the staff view element (Element F logic)
Figure 11:
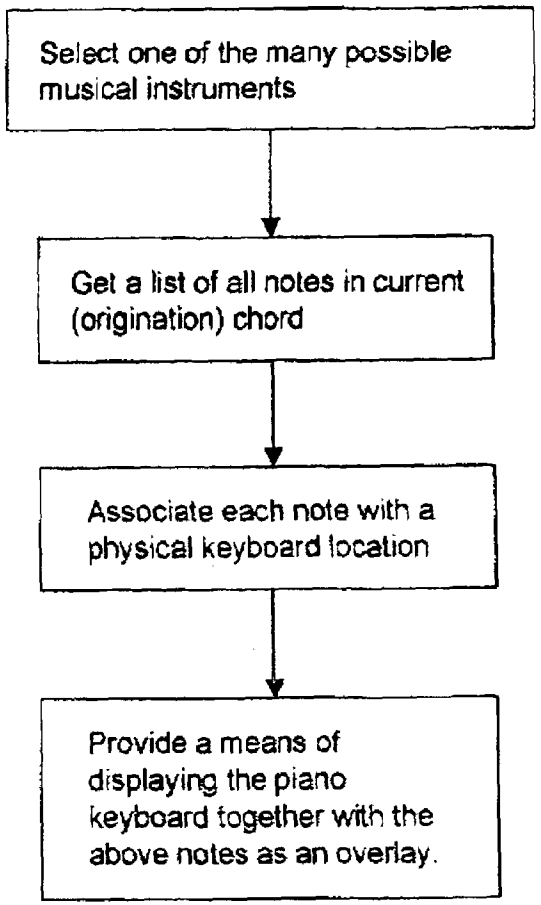
FIG. 11 shows the keyboard view element (Element G logic)
Figure 12:
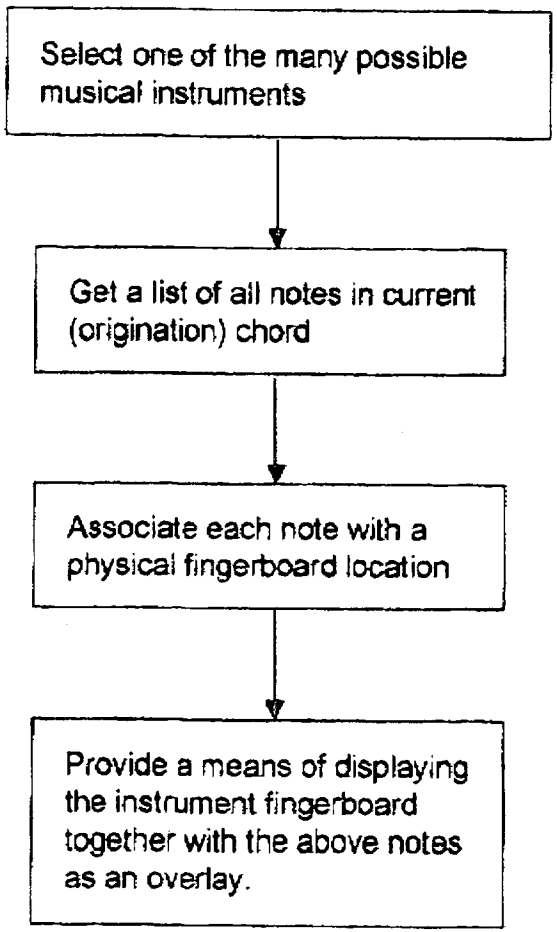
FIG. 12 shows the fingerboard view element (Element H logic)
Figure 13:
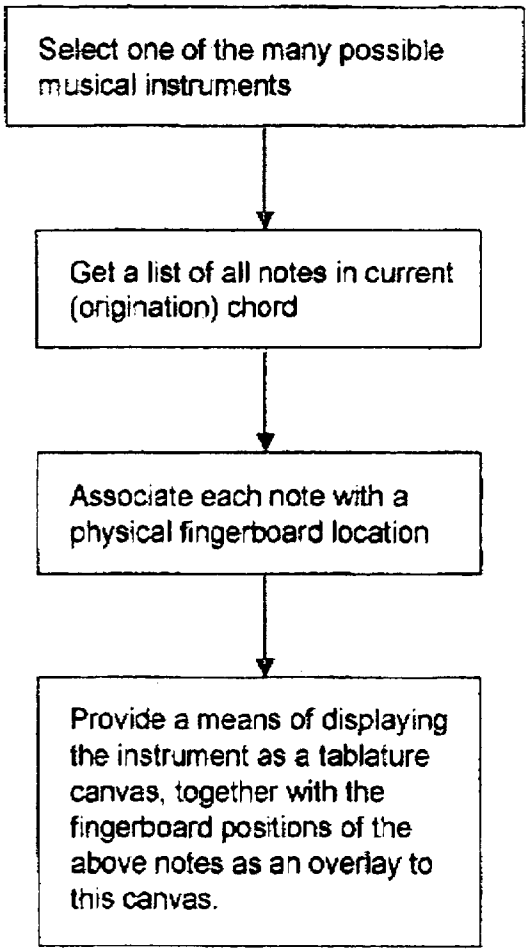
FIG. 13 shows the tablature view element (Element I logic)
Figure 14:
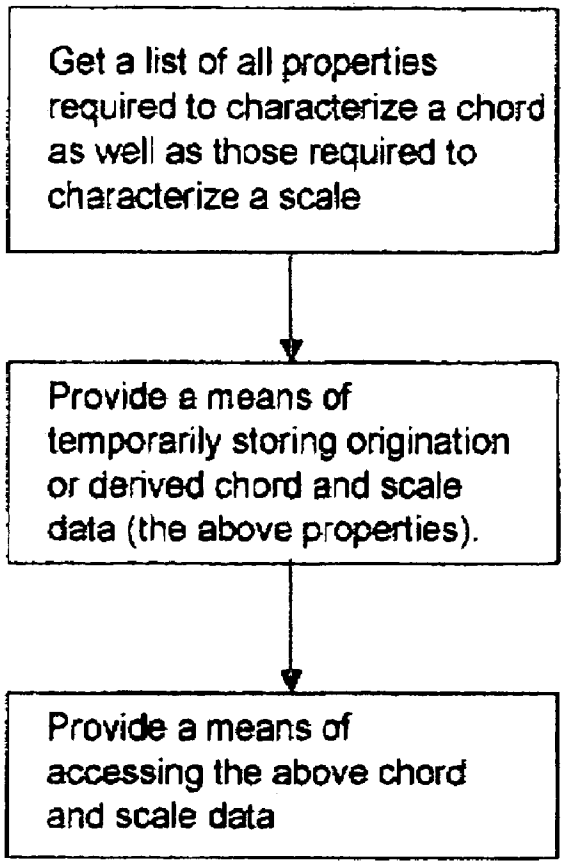
FIG. 14 shows the storage buffer element (Element I logic)
Figure 15:
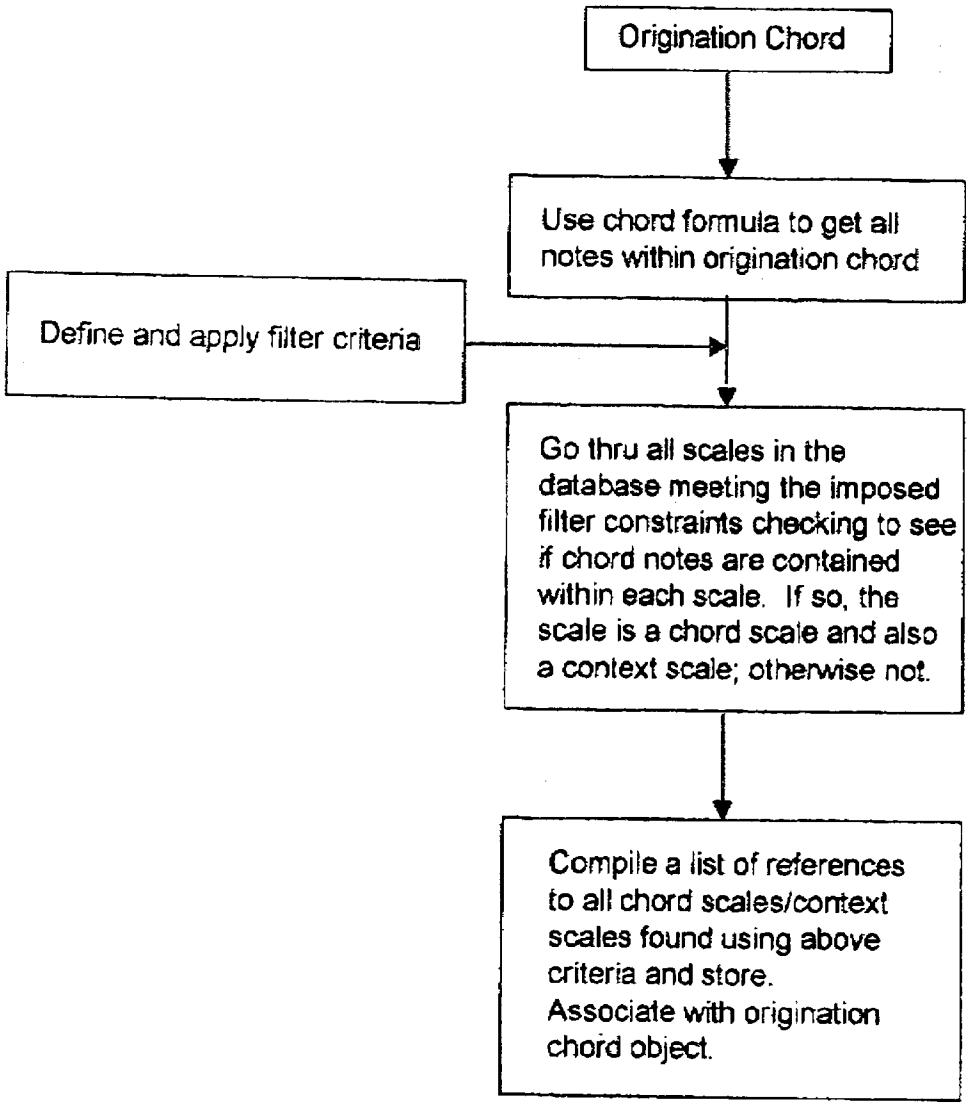
FIG. 15 shows the derivation of chord scales and context scales (Element B)
Figure 16:
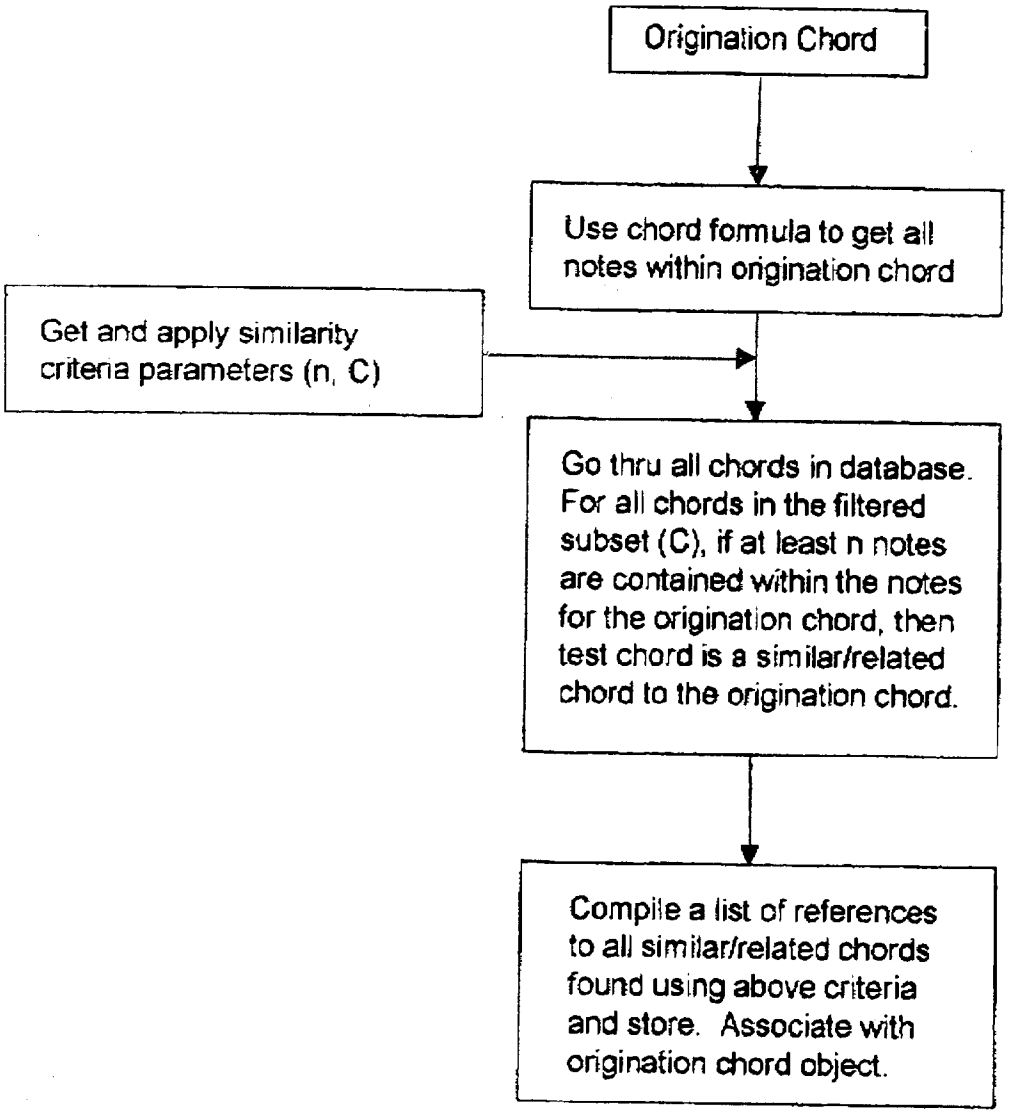
FIG. 16 shows the derivation of similar/related chords (Element B)
Figure 17:
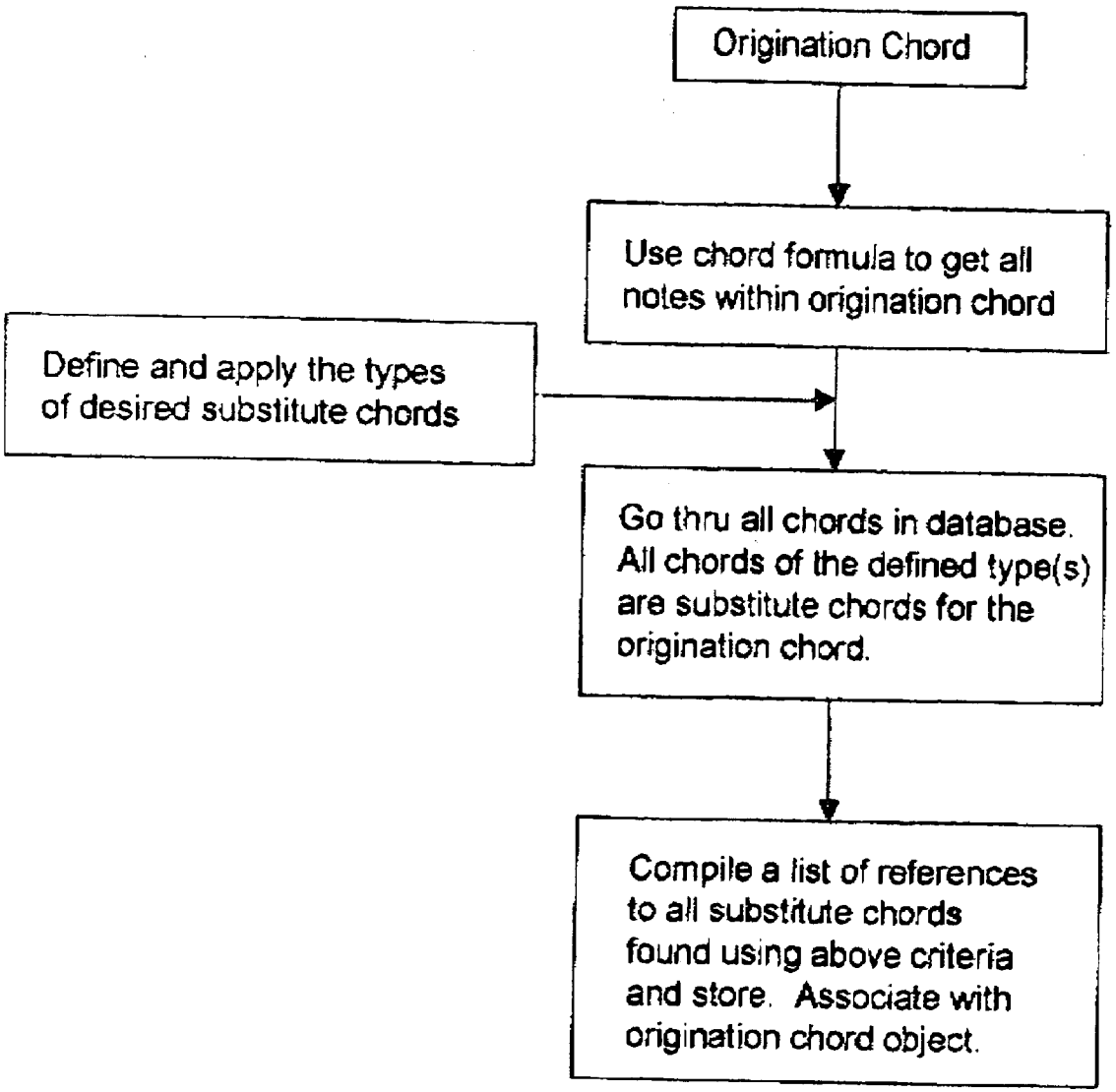
FIG. 17 shows the derivation of substitute chords (Element B)
Figure 18:
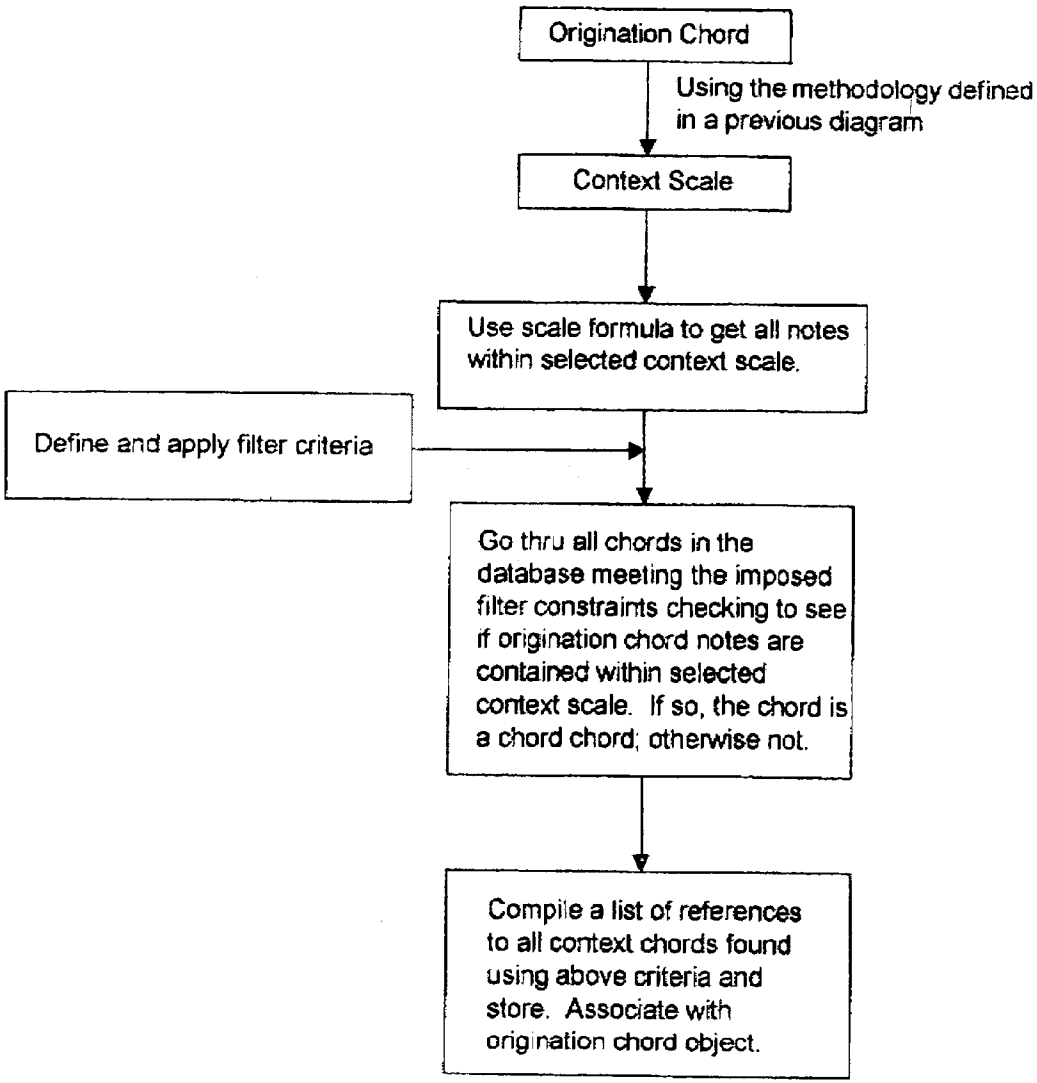
FIG. 18 shows the derivation of context chords (Element B)
Figure 19:
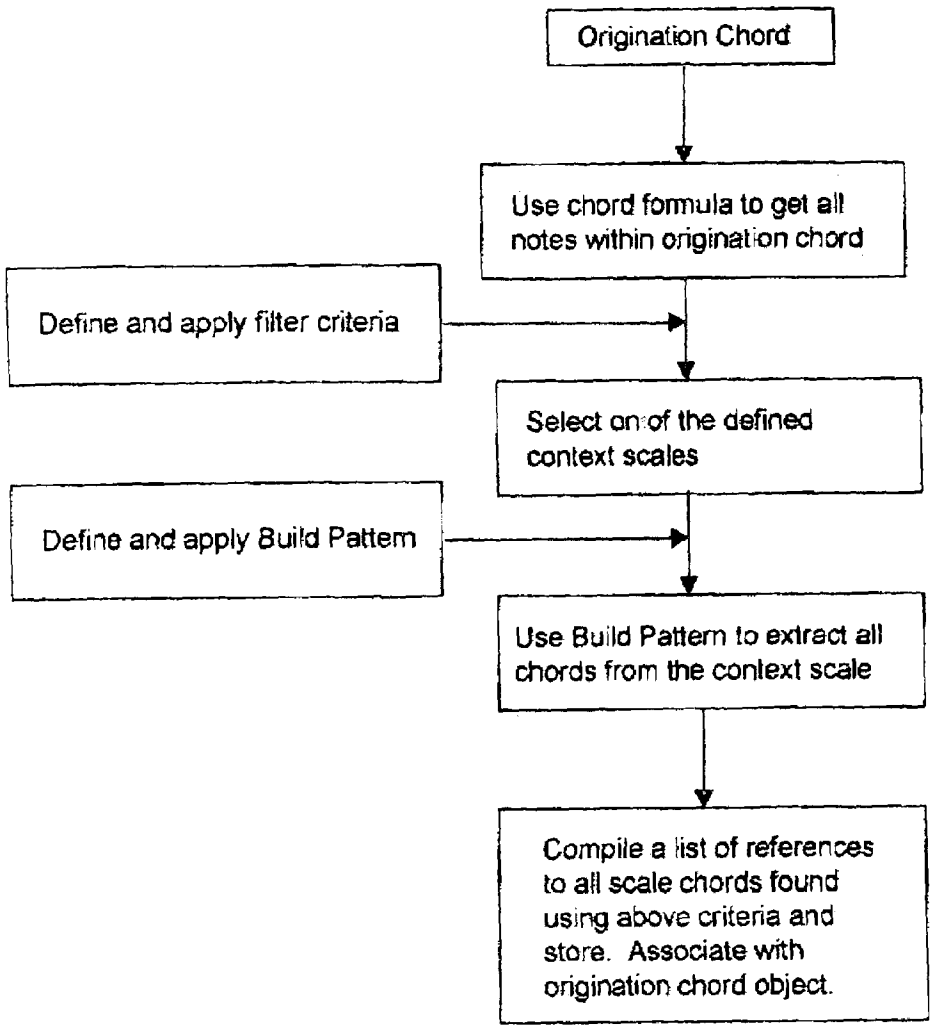
FIG. 19 shows the derivation of scale chords using the chord formula (Element B)
Figure 20:
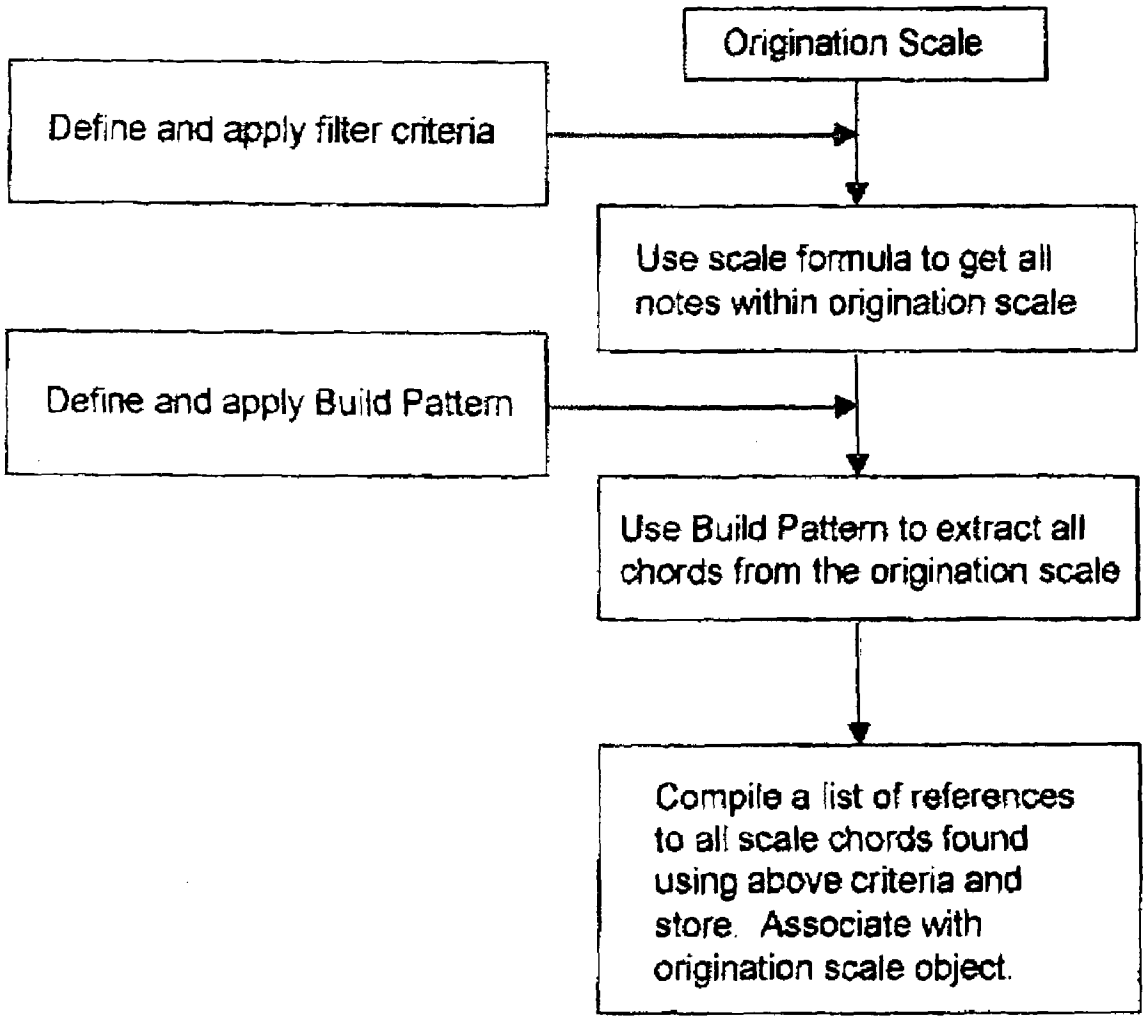
FIG. 20 shows the derivation of scale chords using the scale formula (Element C)
Figure 21:
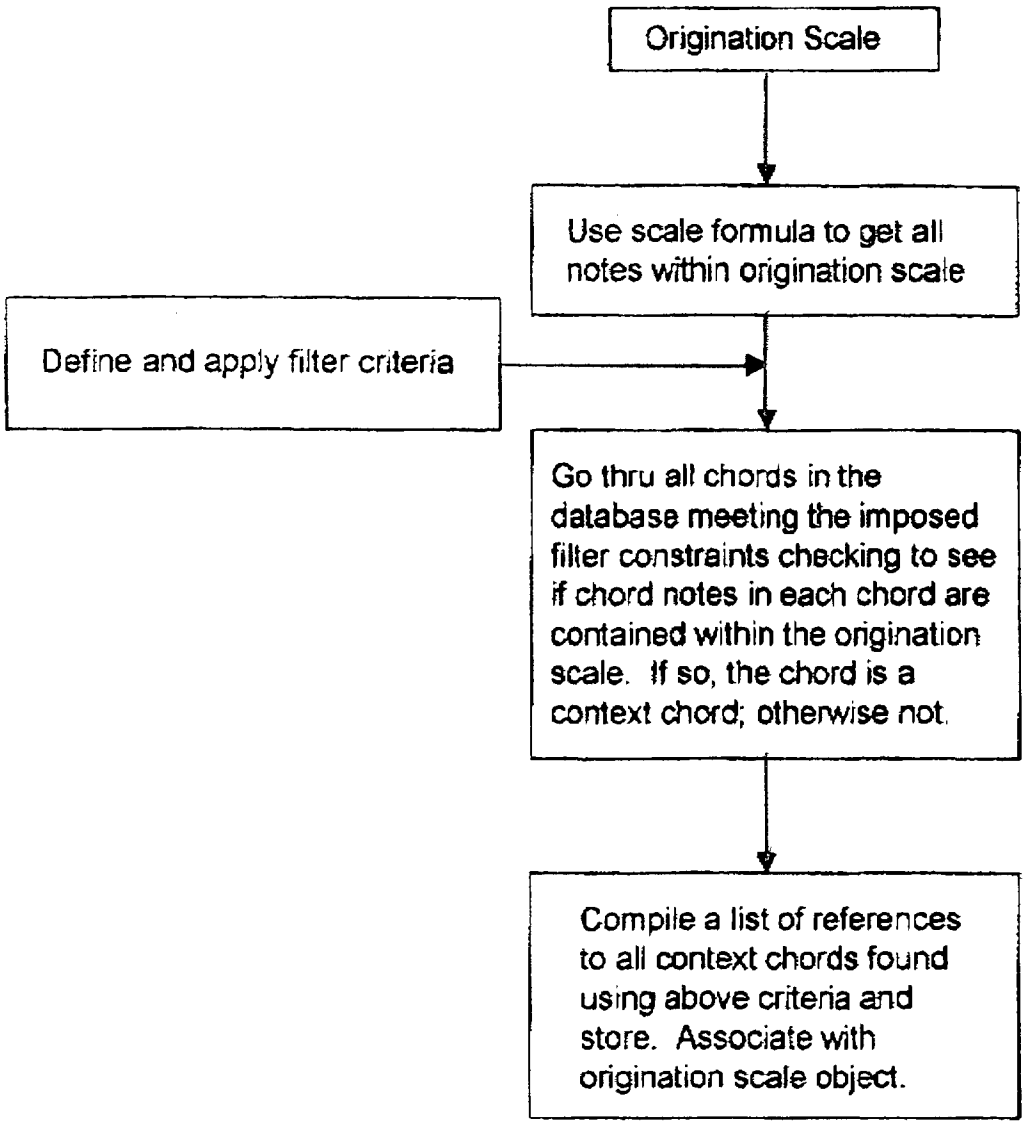
FIG. 21 shows the derivation of context chords (Element C)
Figure 22:
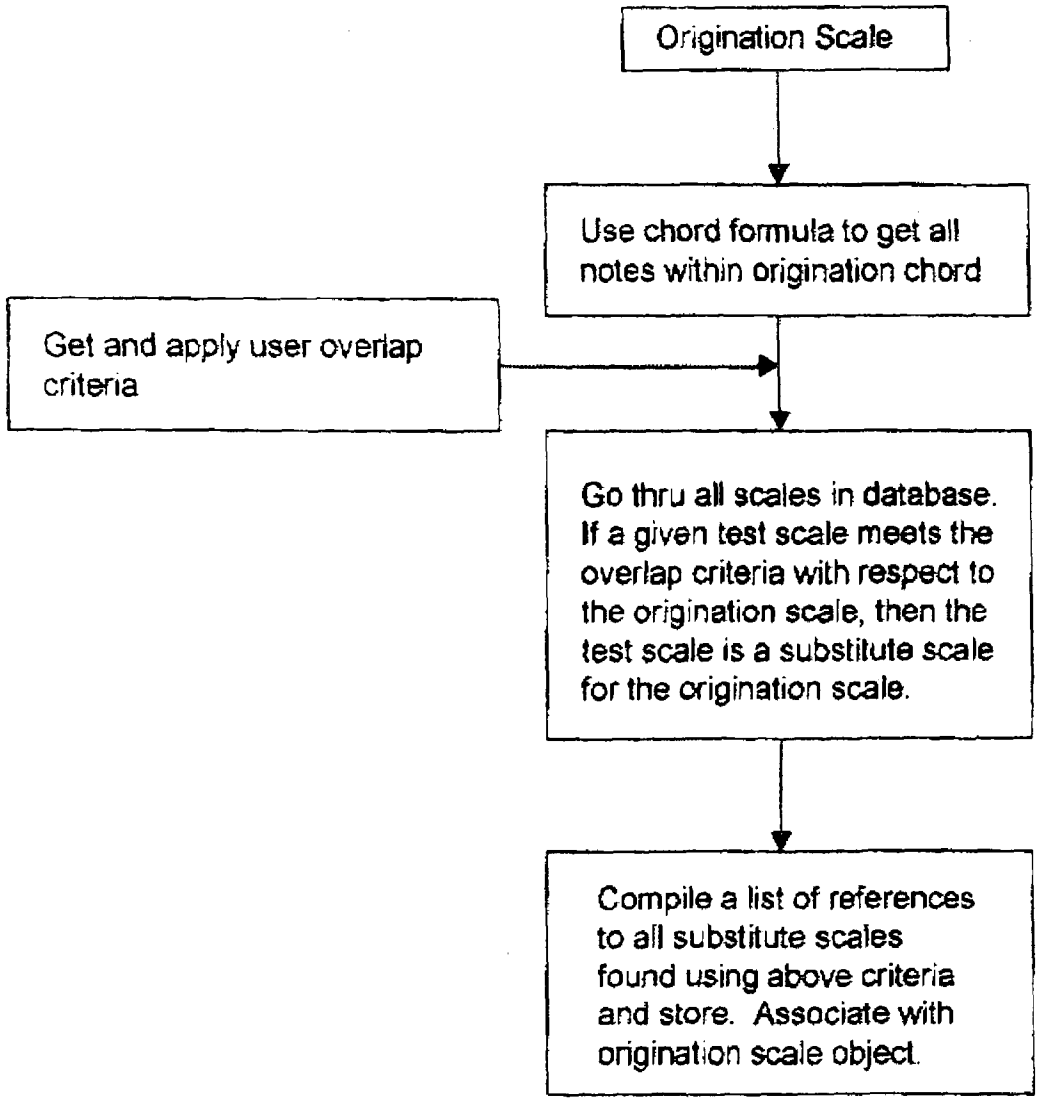
FIG. 22 shows the derivation of substitute scales (Element C)
Figure 23:
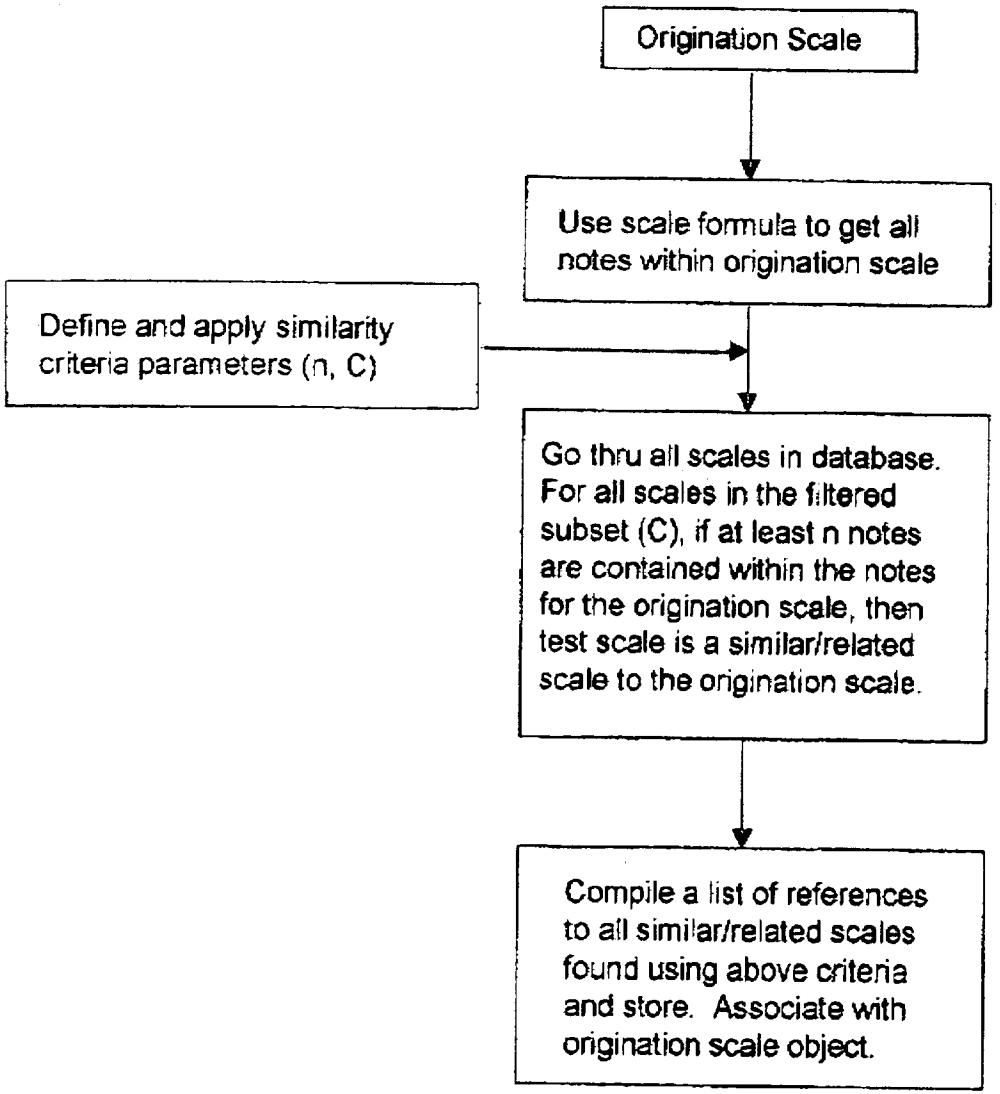
FIG. 23 shows the derivation of similar/related scales (Element C)
Figure 24:
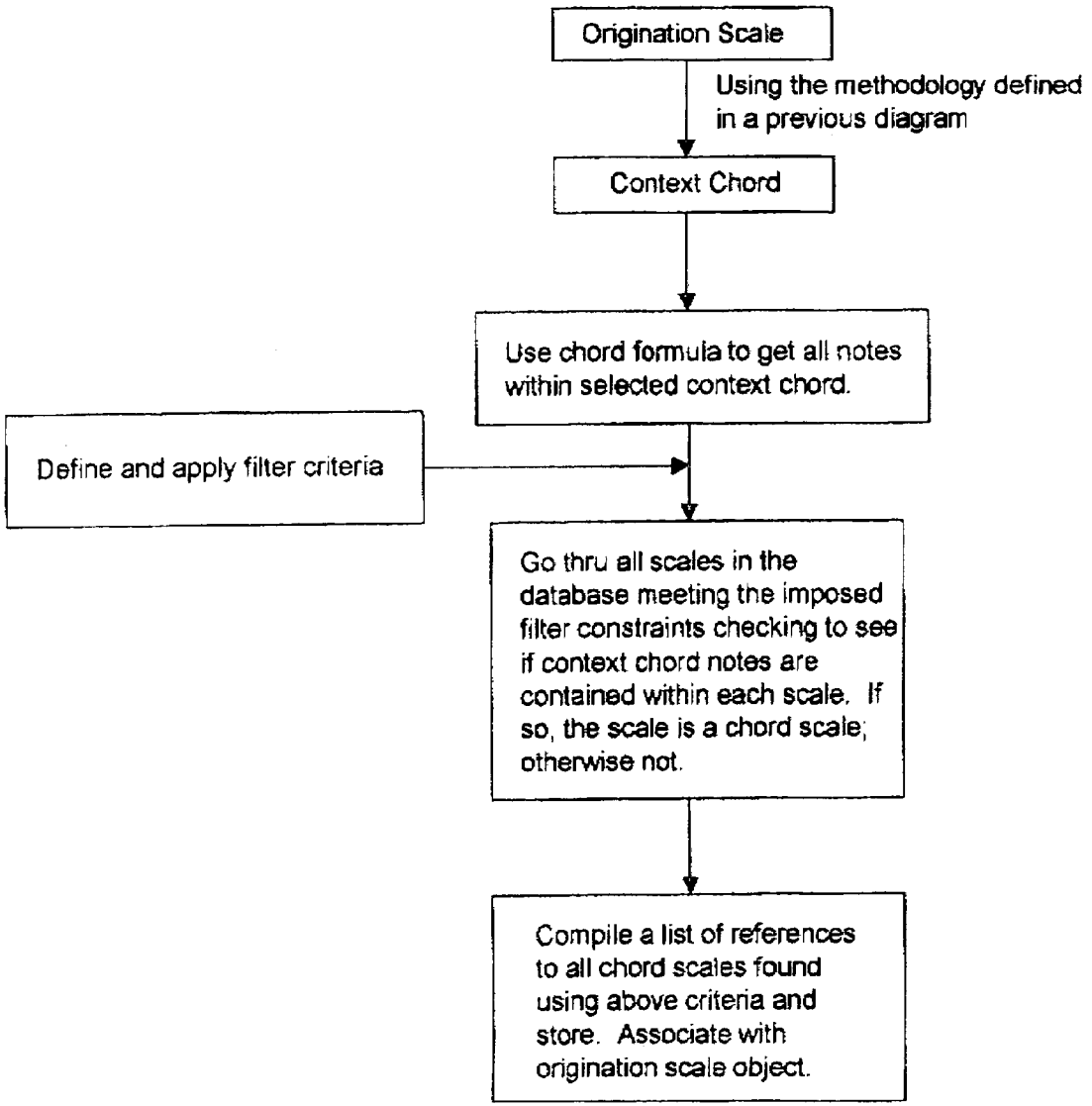
FIG. 24 shows the derivation of chord scales (Element C).

Referring now to FIGS. 2–24 for further illustration of the present invention, FIG. 3 details the overall element interaction, FIG. 4 summarizes the overall methodology, and FIGS. 5–24 provide detailed illustrations. All of these depictions represent proceedings carried out within a processor as would be recognized in the art. As is shown in FIG. 3, there are 10 elements (Elements A–G). The methodology utilized to create music begins with the establishment of a tonal system which is defined as the complete set of all notes from which any chord, arpeggio, scale, composition, or other musical object is derived.

Setting Up the Tonal System

The methodology utilized to create music begins with the establishment of a tonal system—the complete set of all notes from which any chord, arpeggio, scale, composition, or other musical object is derived. Eight octaves are used, with each one containing 12 notes. This amounts to a total of 84 notes, not 96 notes, because the octaves as defined in the chart of FIG. 2 start on "C," but the tonal system discussed herein starts on "D," so some octaves are fragmented. These 84 notes are taken from the larger set of 128 notes defined in the chart of FIG. 2 and contain all notes in the range from D1 (MIDI Note=26, Frequency=36.7080959897 Hertz) to Db8 (MIDI Note=109, Frequency=4434.9220956300 Hertz).

Setting Up the Database for Chord and Scale Data Storage

The next step is to create a database or other storage repository of all chords and scales types. The information stored in the database includes the name and alias names of the chords and scales and the intervallic formula for each chord or scale. The details are provided in FIG. 7. This intervallic formula is essentially a series of musical intervals such that, together with a single root note (which is arbitrary), the chord or scale is fully determined.

Definition and Configuration of Musical Instruments

The next step is to define and configure one or more musical instruments (stringed). This step is summarized in FIG. 5, and begins with defining the relevant parameters for the stringed instrument. These parameters include the number of strings, whether or not the instrument has frets, and the number of frets if present. After defining these parameters for each instrument, each instrument must be tuned. In other words, each open (i.e., how the string would ring out without any fingers pressed down on the fingerboard) string of each instrument must have a single note assigned to it from the set of 84 notes in the tonal system. The open string tuning must be such that: (1) the open string note must be contained inside the tonal system; and (2) after ascending in pitch by one MIDI note (or half step) for each fret on the string, the resulting note on the highest fret (or the top of the pitch range for that string for a fretless instrument) cannot be outside the range of the tonal system.

Defining an Origination Chord and/or Scale

The next step is the selection of a single chord or scale from the foregoing database of chords and scales. This chord or scale will serve as a point of origin for the methodology—hence the name origination chord or origination scale.

The Root Note and Formula of a Chord or Scale are its Identity

Every chord or scale that exists is defined by an intervallic formula—a series of intervals that characterize the chord or scale. This formula is well documented in music theory textbooks and literature and is universally understood by all well-trained musicians. It is this formula that, given an arbitrary starting note, allows a musician to define the musical notes in the chord or scale. Therefore, an arbitrary starting note and an intervallic formula fully define the notes in a given chord or scale. This concept of a starting reference note and an intervallic formula is fundamental and is universally understood by musicians. The origination chord or scale does not need to be based on a pre-established and well-known intervallic formula. Instead, it can be any set of"n" distinct and arbitrarily selected intervals such that n<=12. Therefore, the intervallic formula 1-2-3-4 is a possible origination chord or scale, as are 1-2-3-4-5, 1-2-3-4-5-6, 1-2-3-4-5-6-7, etc. Any subset of 1-2-3-4-5-6-7-8-9-10-11-12 is a possible origination chord As an example, consider a C major seventh chord; its intervallic formula is given by 1-5-8-12. This means that given a starting note, called the root and represented by "1" in the formula, the next note in the chord is located 5 half-step intervals (or 4 MIDI notes [FIG. 2]) above the root. Similarly, the remaining two notes are located 8 and 12 half steps above the root (or 7 and 11 MIDI notes), respectively. Therefore, if the starting note is C4 (MIDI note=24), then the other three notes are E4 (MIDI note=28), G4 (MIDI note=31), and B4 (MIDI note=35).

As another example, consider a C major scale; its intervallic formula is given by 1-3-5-6-8-10-12. This means that given a starting note, called the root and represented by "1" in the formula, the next note in the scale is located 3 half-step intervals (or 2 MIDI notes) above the root. Similarly, the remaining 6 notes are located 5, 6, 8, 10, and 12 half steps above the root (or 4, 5, 7, 9, and 11 MIDI notes), respectively. Therefore, if the starting note is C4 (MIDI note=24), then the other six notes are D4 (MIDI note=26), E4 (MIDI note=28), F4 (MIDI note=29), G4 (MIDI note=31), A4 (MIDI note=33), and B4 (MIDI note=35). It is not strictly necessary to derive secondary chords and/or scales from the foregoing origination chord or scale. These primary objects can be directly utilized to create a composition, but this approach does not fully harness the capability of this invention. The real power of this method comes from derivation, that is, the extension of the foregoing primary origination chord and scale objects to generation additional compositional possibilities/options.

The next optional step includes viewing any or all of the above origination objects on a musical staff, keyboard, instrument fingerboard, or in tablature notation. The details are provided in FIGS. 10, 11, 12, and 13.

Deriving Secondary Chords and/or Scales

As noted, the foregoing origination chords and scales can be used to derive a variety of secondary objects including additional related chords and scales of various types that can offer additional compositional options. These processes are detailed in FIGS. 7 and 7. As discussed above, an arbitrary starting note (the root of the derived chord or scale) together with the derived chord or scale intervallic formula fully defines the notes in the derived chord or scale. After realizing this, it becomes apparent that the question of deriving secondary chords and/or scales from primary ones becomes one of constrained containment. In other words, after specifying a set of filter constraints (narrowing the range of primary origination chords or scales), one checks to see which chords in the database are contained within the origination chord, or, conversely, which chords or scales (again pre-filtered based on constraints) in the database contain the origination chords. In this context, one chord or scale (A) "contains" another chord or scale (B) if the set of all of the notes in B is contained by the set of notes for A. This is absolute containment. There is also relative containment. In this case, one chord or scale (A) "contains" another chord or scale (B) if "n1" notes within the set of all of the "n2" notes in B are contained by the set of "n3" notes for A such that n3>n2>n1.

The abstract mathematical relationships are made more concrete in the following discussions. In particular, the specifics of using an origination chord to derive chord scales/context scales, similar/related chords, substitute chords, context chords, and scale chords are discussed. In addition, the specifics of using an origination scale to derive scale chords, context chords, substitute scales, similar/related scales, context chords, and chord scales are discussed. The specifics of each derived object is detailed separately in FIGS. 15 through 19 and 20 through 24.

Using an Origination Chord to Derive Chord Scales/Context Scales

Given an origination chord (an intervallic formula and root note), the process of deriving a chord scale or context scales includes the following steps. First, the origination chord is expressed as a series of notes using the foregoing methods, based on its formula and root note. Next, a set of filter criteria is defined. Third, the database is queried, extracting the formula of all scales in the filtered subset. Finally, all scales characterized by a set of notes that contain all the notes in the origination chord are identified and stored. These scales are the chord scales (or equivalently, context scales). These two entities are really just different names for the same functionally equivalent object. The only reason for the use two names is that the two equivalent objects are used in different ways by the method, and must remain independent of one another. Hence, the need for two separate, albeit equivalent, objects. This process is detailed in FIG. 17 and is very straightforward as shown. If, for example, the origination chord is C major-6 (which contains the four notes C, E, G, and A) and the filter settings are "All Scales," then the list of chord scales/context scales will include scales such as the C major pentatonic (which contains the notes C, D, E, G, A). In general, any scale rooted on C and containing the notes C, E, G, and A will be included.

Using an Origination Chord to Derive Similar/Related Chords

Given an origination chord (an intervallic formula and root note), the process of deriving similar/related chords includes the following steps. First, the origination chord is expressed as a series of notes using the foregoing methods, based on its formula and root note. Next, a set of similarity criteria parameters (n,C) are defined. Third, the database is queried, extracting the formula of all chords in the filtered subset. Finally, all chords of type/class C characterized by a set of notes that contain at least "n" notes in common with the origination chord are identified and stored. These chords are the similar/related chords. This process is detailed in FIG. 16. As an example, if the origination chord is C major-7 (which contains the four notes C, E, G, and B) and the similarity criteria parameters are n=3 and C="All Chords," then the list of similar/related chords will include chords such as C major-6 (which contains the notes C, E, G, A and therefore has at least three notes in common with C major-7). This list will also contain several other chords generally defined as, any chord rooted on C and containing any two of E, G, or B.

Using an Origination Chord to Derive Substitute Chords

Given an origination chord (an intervallic formula and root note), the process of deriving substitute chords includes the following steps. First, the set of possible or applicable substitute chord types depends on the type or class of the origination chord. The chord type-substitute chord type relationships are well documented in music theory textbooks and literature. (Documentation example: A chord of type dominant-7-#9 can always be substituted for a chord of type minor $7^{th}$.) The origination chord is expressed as a series of notes using the foregoing methods, based on its formula and root note. Next, the type or types of desired substitute chords is/are defined from the foregoing list of possible/applicable choices. Next, the database is queried and all chords of the defined type(s) are identified and stored. These chords are the substitute chords. This process is detailed in FIG. 17. An example follows. In particular, if the origination chord is C dominant-7 (which contains the four notes C, E, G, and Bb) and the types of desired substitute chords are "Show Flat-5 Substitutes" and "Show Non-Scale Chord Substitutes," then the list of substitute chords will include chords such as C# dim-7 (which contains the notes C#, E, G, Bb and therefore has at least three notes in common with C dominant-7). This list will also contain several other chords such as F#7, which is the flat-5 substitute chord for C dominant-7. As noted, these substitutions are well documented in music theory textbooks and literature.

Using an Origination Chord to Derive Context Chords

Given an origination chord (an intervallic formula and root note), the process of deriving a context chord includes the following steps. First, the origination chord is expressed as a series of notes using the foregoing methods, based on its formula and root note. Next, a context scale is defined using the foregoing methodology. Next, a set of filter criteria is defined and the database is queried, extracting the formula of all chords in the filtered subset. Finally, all chords characterized by a set of notes that are contained within the set of all the notes in the above context scale are identified and stored. These chords are the context chords, because they are contained within the defined context scale for the current origination chord. This process is detailed in FIG. 18. Thus, if the origination chord is C major-7 (which contains the four notes C, E, G, and B), then the list of context chords will include chords such as the C major triad (which contains the notes C, E, G). This list will also contain several other chords, depending of the filter settings. In general, any chord rooted on C and containing any two of E, G, or B will be included.

Using an Origination Chord to Derive Scale Chords

Given an origination chord (an intervallic formula and root note), the process of deriving a set of scale chords includes the following steps. First, the origination chord is expressed as a series of notes using the foregoing methods, based on its formula and root note. Next, a context scale is defined using the foregoing methodology. Next, a build pattern is defined that represents a mathematical relationship or rule for extracting scale chords from the above context scale. Next, a set of filter criteria is defined and the database is queried, extracting the formula of all chords in the filtered subset meeting the build pattern constraints. These chords are the scale chords for the current context scale. This process is detailed in FIG. 19. The example in the following section is based on an origination scale rather than a context scale, but is likewise illustrative of the preceding principle.

Using an Origination Scale to Derive Scale Chords

Given an origination scale (an intervallic formula and root note), the process of deriving a set of scale chords includes the following steps. First, the origination scale is expressed as a series of notes using the foregoing methods, based on its formula and root note. Next, a build pattern is defined that represents a mathematical relationship or rule for extracting scale chords from the above origination scale. Next, a set of filter criteria is defined and the database is queried, extracting the formula of all chords in the filtered sub-set meeting the build pattern constraints. These chords are the scale chords for the current origination scale. This process is detailed in FIG. 20 and exemplified as follows. Thus, if the origination scale is C major (which contains the four notes C, D, E, F, G, A and B) and the build pattern is 1-3-5-7, then the list of scale chords will be extracted from the C major scale by taking the first, third, fifth, and seventh notes, the second, fourth, sixth, and eighth notes (the same as 1-3-5-7 but shift by one note), third, fifth, seventh, and ninth notes, etc. Note values greater than the number of notes in the scale (in this case seven) are corrected by subtracting the number of notes in the scale. Therefore, the eighth, ninth, and tenth notes are equivalent to the first, second, and third notes. The first scale chords generated above contains the first, third, fifth, and seventh notes of the C major scale; this is C major-7. The second scale chord contains the second, fourth, sixth, and eighth notes; this is Dm-7. This list will always contain exactly n chords, where "n" is the number of notes in the scale, regardless of the build pattern. By varying the build pattern, it is possible to generate numerous sets of scale chords from the same scale, each with a very different sound.

Using an Origination Scale to Derive Context Chords

Given an origination scale (an intervallic formula and root note), the process of deriving a context chord includes the following steps. First, the origination scale is expressed as a series of notes using the foregoing methods, based on its formula and root note. Next, a set of filter criteria is defined and the database is queried, extracting the formula of all chords in the filtered subset. Finally, all chords characterized by a set of notes that are contained within the set of all the notes in the above origination scale are identified and stored. These chords are the context chords, because they are contained within the defined origination scale. This process is detailed in FIG. 21, while the example provided earlier for deriving context chords from a context scale, rather that an origination scale, also illustrates this principle.

Using an Origination Scale to Derive Substitute Scales

Given an origination scale (an intervallic formula and root note), the process of deriving substitute scales includes the following steps. First, the origination scale is expressed as a series of "N" notes using the foregoing methods, based on its formula and root note. Next, a set of overlap criteria parameters is defined. Finally, scales with either: (1) scales with N−1 notes and at least −1 notes in common; (2) scales with N notes and at least −1 notes in common; (3) scales with N notes and at least N notes in common; or (4) scales with N+1 notes and at least N notes in common are identified and stored. Exactly which of these four options is enforced depends on the above overlap criteria parameter settings. These scales are the substitute scales. This process is detailed in FIG. 22 and exemplified as follows. If the origination scale is C major (which contains the four notes C, D, E, F, G, A and B) and the overlap criteria parameters are defined as "return all scales with seven notes with at least six notes in common," then the list of substitute scales would include a scale such as C major Lydian (mode 4) because this scale contains the seven notes C, D, E, F#, G, A and B, and thus has at least six notes in common with the C major scale.

Using an Origination Scale to Derive Similar/Related Scales

Given an origination scale (an intervallic formula and root note), the process of deriving similar/related scales includes the following steps. First, the origination scale is expressed as a series of notes using the foregoing methods, based on its formula and root note. Next, a set of filter criteria is defined. Next, the database is queried, extracting the formula of all scales in the filtered subset. Next, a set of similarity criteria parameters ("n," "C") are defined. Finally, all scales of type/class "C" characterized by a set of notes that contain at least "n" notes in common with the origination scale are identified and stored. These scales are the similar/related scales. This process is detailed in FIG. 23 and exemplified as follows. If the origination scale is C major (which contains the four notes C, D, E, F, G, A and B) and the similarity criteria parameters are n= 6, C="Eight Note Scales," then the list of similar/related scales will include scales such as C Eight-Tone Spanish (which contains the notes C, D, Eb, E, F, G, A and B and therefore has at least six notes in common with C major). This list will also contain several other scales such as any eight-note scale rooted on C and containing any six of D, E, F, G, A and B.

Using an Origination Scale to Derive Chord Scales

Given an origination scale (an intervallic formula and root note), the process of deriving a chord scale includes the following steps. First, the origination scale is expressed as a series of notes using the foregoing methods, based on its formula and root note. Next, a context chord is defined using the foregoing methodology. Next, a set of filter criteria is defined and the database is queried, extracting the formula of all scales in the filtered subset. Finally, all scales characterized by a set of notes that contain all notes in the set of notes for the above context chord are identified and stored. These scales are the chord scales. This process is detailed in FIG. 24, and its principle is provided earlier in the derivation of chord scales for an origination chord rather that a context chord.

Recycling: Using Derived Objects as Origination Objects

Derived objects can be exported to a storage buffer (see FIG. 14) and then subsequently imported as an origination object. Thus, any of the above derived chords or scales can be fed back into the above process, that is, treated as an origination chord or scale. The next optional step includes viewing any or all of the above derived objects on a musical staff, keyboard, instrument fingerboard, or in tablature notation. The details are provided in FIGS. 10, 11, 12, and 13.

Utilizing Origination and Derived Chords and/or Scales in Chord Charts/Musical Compositions After any number of these iterations, origination and/or derived chords can be used in a chord progression to form a chord chart, i.e., a visual representation of those chord objects specifying their order as well as their rhythm and duration (optional). The chord progression defined by the chord chart could be used as, or as part of a, musical composition. As well, any of the foregoing origination and/or derived scales can be used as, or as part of, music. These strategies are summarized in FIG. 8.

As is thus apparent, the present invention provides a myriad of selection-choices for utilization in innovative formulations of music and improvisations by first choosing the elements generated as described above and thereafter arranging these elements as desired to yield an outcome in accord with the satisfaction of the choice maker.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A method for formulating music, the method comprising:

the steps of providing for subsequent choice a plurality of pre-set musical-instrument objects for formulating music, providing a mathematical framework for formulating new musical-instrument objects for formulating music, choosing one of said pre-set musical-instrument objects or applying said mathematical framework to formulate for subsequent choice a new musical-instrument object equal to one of said musical-instrument objects formulatable using said mathematical framework, and choosing said new musical-instrument object;

the steps of providing for subsequent choice a plurality of chord-progression mathematical relationships for generating chord progressions and determining identity and order of notes of each chord in a generated chord progression, choosing one of said chord-progression mathematical relationships, and applying said chosen chord-progression mathematical relationship to generate a new chord progression equal to all chord progressions formulatable using said chosen chord-progression mathematical relationship;

the steps of providing one or more multiple-note origination chords, determining a mathematical relationship among said notes of each origination chord for determining identity and order of said notes of each origination chord, determining a scale-context mathematical relationship for determining compatible context scales with each origination chord, and applying each scale-context mathematical relationship to each origination chord to develop for subsequent choice a plurality of compatible context scales equal to all compatible context scales formulatable using said origination chords and said scale-context mathematical relationships;

the steps of providing one or more multiple-note origination scales, determining a mathematical relationship among said notes of each origination scale for determining identity and order of said notes of each origination scale, determining a chord-context mathematical relationship for determining compatible context chords with each origination scale, and applying each chord-context mathematical relationship to each origination scale to develop for subsequent choice a plurality of compatible context chords equal to all compatible context chords formulatable using said origination scales and said chord-context mathematical relationships;

the step of choosing at least one of a newly formulated chord progression, compatible context scale, and a compatible context chord from said subsequent choices for utilization for formulating said music; and the step of choosing at least one set of steps selected from the sets of steps consisting of:

a) a set of steps of projecting a viewable image of said subsequent choice and saving said choice for future recall;

b) a set of steps of choosing one of said compatible context scales, determining a mathematical relationship among the notes of the chosen context scale for determining identity and order of the notes of the chosen context scale, determining a context-chord expansion mathematical relationship for determining context chords compatible with the chosen context scale, and applying the context-chord expansion mathematical relationship to the chosen context scale to develop for subsequent choice a plurality of context chords equal to all context chords formulatable using the chosen context scale and said context-chord expansion mathematical relationship;

c) a set of steps of choosing one of said compatible context scales, determining a mathematical relationship among the notes of the chosen context scale for determining identity and order of the notes of the chosen context scale, determining a scale-chord build-pattern mathematical relationship for generating scale chords compatible with the chosen context scale, and applying the scale-chord build-pattern mathematical relationship to the chosen context scale for developing for subsequent choice a plurality of scale chords equal to all scale chords formulatable using the chosen context scale and said scale-chord build-pattern mathematical relationship;

d) a set of steps of determining a chord-scale mathematical relationship for determining chord scales for each origination chord, and applying each chord-scale mathematical relationship to each origination chord for developing for subsequent choice a plurality of chord scales equal to all chord scales formulatable using said origination chords and said chord-scale mathematical relationships;

e) a set of steps of determining a substitute-chord mathematical relationship for determining substitute chords for each origination chord, and applying each substitute-chord mathematical relationship to each origination chord for developing for subsequent choice a plurality of substitute chords equal to all substitute chords formulatable using the aforesaid origination chords and said substitute-chord mathematical relationships;

f) a set of steps of determining a related-chord mathematical relationship for determining related chords for each origination chord, and applying each related-chord mathematical relationship to each origination chord to develop for subsequent choice a plurality of related chords equal to all similar/related chords formulatable using said origination chords and said related-chord mathematical relationships;

g) a set of steps of providing a dictionary look-up algorithm for accessing chord-specific information about any of said origination chords and applying said algorithm for generation for subsequent review and consideration a plurality of dictionary look-up information elements chosen from the group consisting of compatible context scales, context chords, scale chords, chord scales, substitute chords, related chords, chord nomenclature, chord classification, and compositional options for utilizing each origination chord and at least one of said information elements thereof for formulating said music;

h) a set of steps of determining a series of chord-scale mathematical relationships for each of said origination chords for determining chord scales compatible with each origination chord, and applying the chord-scale mathematical relationships for identifying and making available a plurality of chord scales for each of said origination chords equal to all chord scales formulatable using said origination chords and said chord-scale mathematical relationships;

i) a set of steps of choosing one of said compatible context chords, determining a mathematical relationship among the notes of the chosen context chord for determining identity and order of the notes of the chosen context chord, determining a chord-scale expansion mathematical relationship for determining chord scales for the chosen context chord, and applying the chord-scale expansion mathematical relationship to the chosen context chord for developing for subsequent choice a plurality of chord scales equal to all chord scales formulatable using the chosen context chord and said chord-scale expansion mathematical relationship;

j) a set of steps of determining a scale-chord build-pattern mathematical relationship for generating scale chords compatible with each origination scale, and applying each scale-chord build-pattern mathematical relationship to each origination scale for developing for subsequent choice a plurality of scale chords equal to all scale chords formulatable using said origination scales and said scale-chord build-pattern mathematical relationships;

k) a set of steps of determining a context-chord mathematical relationship for determining context chords compatible with each origination scale, and applying each context-chord mathematical relationship to each origination scale for developing for subsequent choice a plurality of context chords equal to all context chords formulatable using said origination scales and said context-chord mathematical relationships;

l) a set of steps of determining a related-scale mathematical relationship for determining related scales for each origination scale, and applying each related-scale mathematical relationship to each origination scale to develop for subsequent choice a plurality of related scales equal to all related scales formulatable using said origination scales and said related-scale mathematical relationships;

m) a set of steps of determining a substitute-scale mathematical relationship for determining substitute scales for each origination scale, and applying each substitute-scale mathematical relationship to each origination scale for developing for subsequent choice a plurality of substitute scales equal to all substitute scales formulatable using said origination scales and said substitute-scale mathematical relationships;

n) a set of steps of providing a dictionary look-up algorithm for accessing scale-specific information about any of said origination scales and applying said algorithm for generating for subsequent review and consideration a plurality of dictionary look-up information elements chosen from the group consisting of compatible context scales, context chords, scale chords, chord scales, substitute chords, related chords, chord nomenclature, chord classification, and compositional options for utilizing each origination chord and at least one of said information elements thereof for formulating said music; and o) a set of steps of determining a series of scale-chord build-pattern mathematical relationships for each of said origination scales for determining scale chords for each origination scale, and applying the scale-chord build-pattern mathematical relationships for identifying and making available a plurality of scale chords for each of said origination scales equal to all scale chords formulatable using said origination scales and said scale-chord build-pattern mathematical relationships.

2. A method for formulating music as claimed in claim 1 additionally comprising the step of choosing at least one of a newly formulated chord progression, compatible context scale, and a compatible context chord from these subsequent choices for utilization for formulating said music.

3. A method for formulating music as claimed in claim 1 additionally comprising the step of choosing at least one of a newly formulated chord progression, compatible context scale, compatible context chord, and a scale chord from said subsequent choices for utilization for formulating said music.

4. A method for formulating music as claimed in claim 1 additionally comprising the step of choosing at least one of a newly formulated chord progression, compatible context scale, compatible context chord, scale chord, and a chord scale from these subsequent choices for utilization in formulating music.

5. A method for formulating music as claimed in claim 1 additionally comprising the step of choosing at least one of a newly formulated chord progression, compatible context scale, compatible context chord, scale chord, chord scale, and a substitute chord from said subsequent choices for utilization in formulating said music.

6. A method for formulating music as claimed in claim 1 additionally comprising the step of choosing at least one of a newly formulated chord progression, compatible context scale, compatible context chord, scale chord, chord scale, substitute chord, and a related chord from these subsequent choices for utilization for formulating said music.

7. A method for formulating music as claimed in claim 1 additionally comprising the step of choosing at least one of a newly formulated chord progression, compatible context scale, compatible context chord, scale chord, chord scale, substitute chord, related chord, and dictionary look-up information element from said subsequent choices for utilization for formulating said music.

8. A method for formulating music as claimed in claim 1 additionally comprising the step of choosing at least one of a newly formulated chord progression, compatible context scale, compatible context chord, scale chord, chord scale, substitute chord, related chord, and dictionary look-up information element from said subsequent choices for utilization for formulating said music.

9. A method for formulating music as claimed in claim 1 additionally comprising the step of choosing at least one of a newly formulated chord progression, compatible context scale, compatible context chord, scale chord, chord scale, substitute chord, related chord, and dictionary look-up information element from said subsequent choices for utilization in formulating music.

10. A method for formulating music as claimed in claim 1 additionally comprising the step of choosing at least one of a newly formulated chord progression, compatible context scale, compatible context chord, scale chord, chord scale, substitute chord, related chord, and dictionary look-up information element from said subsequent choices for utilization for formulating said music.

11. A method for formulating music as claimed in claim 1 additionally comprising the step of choosing at least one of a newly formulated chord progression, compatible context scale, compatible context chord, scale chord, chord scale, substitute chord, related chord, and dictionary look-up information element from said subsequent choices for utilization for formulating said music.

12. A method for formulating music as claimed in claim 1 additionally comprising the step of choosing at least one of a newly formulated chord progression, compatible context scale, compatible context chord, scale chord, chord scale, substitute chord, related chord, dictionary look-up information element, and a related scale from these subsequent choices for utilization for formulating said music.

13. A method for formulating music as claimed in claim 1 additionally comprising the step of choosing at least one of a newly formulated chord progression, compatible context scale, compatible context chord, scale chord, chord scale, substitute chord, related chord, dictionary look-up information element, related scale, and a substitute scale from these subsequent choices for utilization for formulating said music.

14. A method for formulating music as claimed in claim 1 additionally comprising the step of choosing at least one of a newly formulated chord progression, compatible context scale, compatible context chord, scale chord, chord scale, substitute chord, related chord, dictionary look-up information element, related scale, and a substitute scale from these subsequent choices for utilization for formulating said music.

15. A method for modifying and/or expanding a musical chord where said expanding is founded upon an origination chord, the method comprising the steps of:

the steps of providing for subsequent choice a plurality of pre-set musical-instrument objects for formulating music, providing a mathematical framework for formulating new musical-instrument objects for formulating music, choosing one of said pre-set musical-instrument objects or applying said mathematical framework for formulating for subsequent choice a new musical-instrument object equal to one of the musical-instrument objects formulatable using said mathematical framework, and choosing said new musical-instrument object;

the steps of providing one or more multiple-note origination chords, determining a mathematical relationship among the notes of each origination chord for determining identity and order of the notes of each origination chord, determining a scale-context mathematical relationship for determining compatible context scales with each origination chord, and applying each scale-context mathematical relationship to each origination chord for developing for subsequent choice a plurality of compatible context scales equal to all compatible context scales formulatable using said origination chords and said scale-context mathematical relationships;

the step of choosing at least one of the newly modified and/or expanded compatible context scales from said subsequent choices for utilization for formulating the music; and the step of choosing at least one set of steps selected from the sets of steps consisting of:

a) a set of steps of projecting a viewable image of said subsequent choice and saving said choice for future recall;

b) a set of steps of choosing one of said compatible context scales, determining a mathematical relationship among the notes of the chosen context scale for determining identity and order of the notes of the chosen context scale, determining a context-chord expansion mathematical relationship for determining context chords compatible with the chosen context scale, and applying the context-chord expansion mathematical relationship to the chosen context scale for developing for subsequent choice a plurality of context chords equal to all context chords formulatable using the chosen context scale and said context-chord expansion mathematical relationship;

c) a set of steps choosing one of said compatible context scales, determining a mathematical relationship among the notes of the chosen context scale for determining identity and order of the notes of the chosen context scale, determining a scale-chord build-pattern mathematical relationship for generating scale chords compatible with the chosen context scale, and applying the scale-chord build-pattern mathematical relationship to the chosen context scale for developing for subsequent choice a plurality of scale chords equal to all scale chords formulatable using the chosen context scale and said scale-chord build-pattern mathematical relationship;

d) a set of steps the steps of determining a chord-scale mathematical relationship for determining chord scales for each origination chord, and applying each chord-scale mathematical relationship to each origination chord for developing for subsequent choice a plurality of chord scales equal to all chord scales formulatable using said origination chords and said chord-scale mathematical relationships;

e) a set of steps of determining a substitute-chord mathematical relationship for determining substitute chords for each origination chord, and applying each substitute-chord mathematical relationship to each origination chord for developing for subsequent choice a plurality of substitute chords equal to all substitute chords formulatable using said origination chords and said substitute-chord mathematical relationships; f) a set of steps of determining a related-chord mathematical relationship for determining related chords for each origination chord, and applying each related-chord mathematical relationship to each origination chord for developing for subsequent choice a plurality of related chords equal to all related chords formulatable using said origination chords and said related-chord mathematical relationships;

g) a set of steps of providing a dictionary look-up algorithm for accessing chord-specific information about any of said origination chords and applying said algorithm to generate for subsequent review and consideration a plurality dictionary look-up information elements chosen from the group consisting of compatible context scales, context chords, scale chords, chord scales, substitute chords, related chords, chord nomenclature, chord classification, and compositional options for utilizing each origination chord and at least one of said information elements thereof for formulating said music;

h) a set of steps of determining a series of chord-scale mathematical relationships for each of said origination chords for determining chord scales compatible with each origination chord, and applying the chord-scale mathematical relationships for identifying and making available a plurality of chord scales for each of said origination chords equal to all chord scales formulatable using said origination chords and said chord-scale mathematical relationships;

i) a set of steps of determining key-based transposition mathematical relationship among the notes of each origination chord for determining a transposed chord for each origination chord, and applying each key-based transposition mathematical relationship to each origination chord for developing for subsequent choice a plurality of transposed chords equal to all transposed chords formulatable using said origination chords and said key-based transposition mathematical relationships; and j) a set of steps of determining interval-based transposition mathematical relationship among the notes of each origination chord for determining a transposed chord for each origination chord, and applying each interval-based transposition mathematical relationship to each origination chord for developing for subsequent choice a plurality of transposed chords equal to all transposed chords formulatable using said origination chords and said interval-based transposition mathematical relationships.

16. A method for modifying and/or expanding a musical chord as claimed in claim 15 additionally comprising the step of choosing at least one of a newly modified and/or expanded compatible context scale and a compatible context chord from these subsequent choices for utilization for formulating said music.

17. A method for modifying and/or expanding a musical chord as claimed in claim 15 additionally comprising the step of choosing at least one of a newly modified and/or expanded compatible context scale, compatible context chord, and a scale chord from these subsequent choices for utilization for formulating said music.

18. A method for modifying and/or expanding a musical chord as claimed in claim 15 additionally comprising the step of choosing at least one of a newly modified and/or expanded compatible context scale, compatible context chord, scale chord, and a chord scale from these subsequent choices for utilization for formulating said music.

19. A method for modifying and/or expanding a musical chord as claimed in claim 15 additionally comprising the step of choosing at least one of a newly modified and/or expanded compatible context scale, compatible context chord, scale chord, chord scale, and a substitute chord from said subsequent choices for utilization for formulating said music.

20. A method for modifying and/or expanding a musical chord as claimed in claim 15 additionally comprising the step of choosing at least one of a newly modified and/or expanded compatible context scale, compatible context chord, scale chord, chord scale, substitute chord, and a related chord from said subsequent choices for utilization for formulating said music.

21. A method for modifying and/or expanding a musical chord as claimed in claim 15 additionally comprising the step of choosing at least one of a newly modified and/or expanded compatible context scale, compatible context chord, scale chord, chord scale, substitute chord, related chord, and a dictionary look-up information element from said subsequent choices for utilization for formulating said music.

22. A method for modifying and/or expanding a musical chord as claimed in claim 15 additionally comprising the step of choosing at least one of a newly modified and/or expanded compatible context scale, compatible context chord, scale chord, chord scale, substitute chord, related chord, and a dictionary look-up information element from said subsequent choices for utilization for formulating said music.

23. A method for modifying and/or expanding a musical chord as claimed in claim 15 additionally comprising the step of choosing at least one of a newly modified and/or expanded compatible context scale, compatible context chord, scale chord, chord scale, substitute chord, related chord, dictionary look-up information element, and a transposed chord from said subsequent choices for utilization for formulating said music.

24. A method for modifying and/or expanding a musical chord as claimed in claim 15 additionally comprising the step of choosing at least one of a newly modified and/or expanded compatible context scale, compatible context chord, scale chord, chord scale, substitute chord, related chord, dictionary look-up information element, and a transposed chord from said subsequent choices for utilization for formulating said music.

25. A method for modifying and/or expanding a musical scale where said expanding is founded upon an origination scale, the method comprising:

the steps of providing for subsequent choice a plurality of pre-set musical-instrument objects for formulating music, providing a mathematical framework for formulating new musical-instrument objects for formulating music, choosing one of said pre-set musical-instrument objects or applying said mathematical framework for formulating for subsequent choice a new musical-instrument object equal to one of the musical-instrument objects formulatable using said mathematical framework, and choosing said new musical-instrument object;

the steps of providing one or more multiple-note origination scales, determining a mathematical relationship among the notes of each origination scale for determining identity and order of the notes of each origination scale, determining a chord-context mathematical relationship for determining compatible context chords with each origination scale, and applying each chord-context mathematical relationship to each origination scale for developing for subsequent choice a plurality of compatible context chords equal to all compatible context chords formulatable using said origination scales and said chord-context mathematical relationships;

the step of choosing at least one of the newly modified and/or expanded compatible context chords from said subsequent choices for utilization for formulating the music; and the step of choosing at least one set of steps selected from the sets of steps consisting of:

a) a set of steps of projecting a viewable image of said subsequent choice and saving said choice for fixture recall;

b) a set of steps of choosing one of said compatible context chords, determining a mathematical relationship among the notes of the chosen context chord for determining identity and order of the notes of the chosen context chord, determining a chord-scale expansion mathematical relationship for determining chord scales for the chosen context chord, and applying the chord-scale expansion mathematical relationship to the chosen context chord for developing for subsequent choice a plurality of chord scales equal to all chord scales formulatable using the chosen context chord and said chord-scale expansion mathematical relationship;

c) a set of steps of determining a scale-chord build-pattern mathematical relationship for generating scale chords compatible with each origination scale, and applying each scale-chord build-pattern mathematical relationship to each origination scale for developing for subsequent choice a plurality of scale chords equal to all scale chords formulatable using said origination scales and said scale-chord build-pattern mathematical relationships;

d) a set of steps of determining a context-chord mathematical relationship for determining context chords compatible with each origination scale, and applying each context-chord mathematical relationship to each origination scale for developing for subsequent choice a plurality of context chords equal to all context chords formulatable using said origination scales and said context-chord mathematical relationships;

e) a set of steps of determining a related-scale mathematical relationship for determining related scales for each origination scale, and applying each related-scale mathematical relationship to each origination scale for developing for subsequent choice a plurality of related scales equal to all related scales formulatable using said origination scales and said related-scale mathematical relationships;

f) a set of steps of determining a substitute-scale mathematical relationship for determining substitute scales for each origination scale, and applying each substitute-scale mathematical relationship to each origination scale for developing for subsequent choice a plurality of substitute scales equal to all substitute scales formulatable using said origination scales and said substitute-scale mathematical relationships;

g) a set of steps of providing a dictionary look-up algorithm for accessing scale-specific information about any of said origination scales and applying said algorithm to generate for subsequent review and consideration a plurality dictionary look-up information elements chosen from the group consisting of compatible context scales, context chords, scale chords, chord scales, substitute chords, related chords, chord nomenclature, chord classification, and compositional options for utilizing each origination chord and at least one of said information elements thereof for formulating the music; and h) a set of steps of determining a series of scale-chord build-pattern mathematical relationships for each of said origination scales for determining scale chords for each origination scale, and applying the scale-chord build-pattern mathematical relationships for identifying and making available a plurality of scale chords for each of said origination scales equal to all scale chords formulatable using said origination scales and said scale-chord build-pattern mathematical relationships.

26. A method for modifying and/or expanding a musical scale as claimed in claim 25, the method additionally comprising the step of choosing at least one of a newly modified and/or expanded compatible context chord and a chord scale from said subsequent choices for utilization for formulating said music.

27. A method for modifying and/or expanding a musical scale as claimed in claim 25, the method additionally comprising the step of choosing at least one of a newly modified and/or expanded compatible context chord, chord scale, and a scale chord from these subsequent choices for utilization for formulating said music.

28. A method for modifying and/or expanding a musical scale as claimed in claim 25, the method additionally comprising the step of choosing at least one of a newly modified and/or expanded compatible context chord, chord scale, and a scale chord from these subsequent choices for formulating said music.

29. A method for modifying and/or expanding a musical scale as claimed in claim 25, the method additionally comprising the step choosing at least one of a newly modified and/or expanded compatible context chord, chord scale, scale chord, and a related scale from these subsequent choices for formulating said music.

30. A method for modifying and/or expanding a musical scale as claimed in claim 25, the method additionally comprising the step of choosing at least one of a newly modified and/or expanded compatible context chord, chord scale, scale chord, related scale, and a substitute scale from these subsequent choices for utilization for formulating said music.

31. A method for modifying and/or expanding a musical scale as claimed in claim 25, the method additionally comprising the step of choosing at least one of a newly modified and/or expanded compatible context chord, chord scale, scale chord, related scale, substitute scale, and a dictionary look-up information element from these subsequent choices for utilization for formulating said music.

32. A method for modifying and/or expanding a musical scale as claimed in claim 25, the method additionally comprising the step of choosing at least one of a newly modified and/or expanded compatible context chord, chord scale, scale chord, related scale, substitute scale, and a dictionary look-up information element from these subsequent choices for utilization for formulating said music.

* * * * *